US009200457B2

(12) United States Patent
Johnson et al.

(10) Patent No.: US 9,200,457 B2
(45) Date of Patent: Dec. 1, 2015

(54) VENTILATING SPACING STRIP BETWEEN REAR SURFACE OF SIDING AND OUTER SURFACE OF STRUCTURE ALLOWING HORIZONTAL AIR CIRCULATION

(75) Inventors: Jay A. Johnson, Lake Elmo, MN (US); Michael D. Conroy, Afton, MN (US); Kurt D. Daniels, St. Paul, MN (US)

(73) Assignee: Finn Systems, LLC, Afton, MN (US)

( * ) Notice: Subject to any disclaimer, the term of this patent is extended or adjusted under 35 U.S.C. 154(b) by 1024 days.

(21) Appl. No.: 12/822,854

(22) Filed: Jun. 24, 2010

(65) Prior Publication Data

US 2010/0257799 A1 Oct. 14, 2010

Related U.S. Application Data

(63) Continuation of application No. 11/365,241, filed on Mar. 1, 2006, now Pat. No. 7,765,754, which is a continuation-in-part of application No. 11/297,543, filed on Dec. 8, 2005, now abandoned.

(51) Int. Cl.
*E04B 1/70* (2006.01)
*E04F 13/08* (2006.01)

(52) U.S. Cl.
CPC ..... *E04F 13/0864* (2013.01); *E04B 1/70* (2013.01)

(58) Field of Classification Search
CPC ..... E04F 13/0864; E04B 1/70
USPC ..... 52/95, 212, 204.53, 504.54, 716.8, 52/717.05, 831, 302.3, 553
See application file for complete search history.

(56) References Cited

U.S. PATENT DOCUMENTS

| | | | | |
|---|---|---|---|---|
| 2,724,872 | A | 11/1955 | Herbes | |
| 2,859,486 | A | 11/1958 | Rovich | |
| 2,923,384 | A | 2/1960 | Black | |
| 3,092,220 | A | 6/1963 | Black | |
| 3,735,538 | A * | 5/1973 | Ramins | 52/94 |
| 3,761,603 | A | 9/1973 | Hays et al. | |
| 4,277,926 | A | 7/1981 | Sherman et al. | |
| 4,916,875 | A | 4/1990 | Kashiwagi | |
| 5,191,745 | A | 3/1993 | Story | |
| 5,224,318 | A | 7/1993 | Kemerer | |

(Continued)

FOREIGN PATENT DOCUMENTS

| | | |
|---|---|---|
| DE | 3712933 | 2/1988 |
| EP | 0719953 | 7/1996 |

(Continued)

OTHER PUBLICATIONS

Battens Plus, http://www.battensplus.com (1 page), Mar. 17, 2004.

(Continued)

*Primary Examiner* — Adriana Figueroa
(74) *Attorney, Agent, or Firm* — Brooks, Cameron & Huebsch PLLC

(57) ABSTRACT

Spacers and a spacing strip for use in an outer wall of a building between the outer vertical surface of its underlying structure and the inner surface of siding through which the siding is nailed to the underlying structure to provide a ventilation space between the rear surface of the siding and the outer surface of the underlying structure. Ventilation channels can be provided at both the lower and upper ends of the ventilation space to facilitate movement of air to the atmosphere from such a ventilation space.

11 Claims, 11 Drawing Sheets

(56) References Cited

U.S. PATENT DOCUMENTS

| | | | | |
|---|---|---|---|---|
| 5,537,791 | A * | 7/1996 | Champagne | 52/520 |
| 5,575,127 | A | 11/1996 | O'Neal | |
| 5,634,314 | A * | 6/1997 | Champagne | 52/712 |
| 5,675,955 | A * | 10/1997 | Champagne | 52/521 |
| 5,791,112 | A | 8/1998 | Plum | |
| 5,826,390 | A | 10/1998 | Sacks | |
| 5,836,113 | A * | 11/1998 | Bachman | 52/94 |
| 5,953,883 | A | 9/1999 | Ojala | |
| 5,956,914 | A * | 9/1999 | Williamson | 52/520 |
| 6,067,764 | A | 5/2000 | Johansen | |
| 6,233,890 | B1 | 5/2001 | Tonyan | |
| 6,272,797 | B1 * | 8/2001 | Finger | 52/94 |
| 6,505,448 | B2 | 1/2003 | Ito | |
| 6,584,735 | B2 * | 7/2003 | Burton | 52/95 |
| 6,594,965 | B2 | 7/2003 | Coulton | |
| 6,679,010 | B2 * | 1/2004 | Honda | 52/95 |
| 6,725,618 | B2 | 4/2004 | Albracht | |
| 6,786,013 | B2 | 9/2004 | Coulton | |
| 6,883,288 | B1 * | 4/2005 | Harbin | 52/521 |
| 6,973,757 | B2 | 12/2005 | Marks | |
| 7,131,788 | B2 | 11/2006 | Ianniello et al. | |
| 7,154,052 | B2 | 12/2006 | Stempinski | |
| 7,223,925 | B2 | 5/2007 | Ewer et al. | |
| 7,383,669 | B2 * | 6/2008 | Morse | 52/545 |
| 7,424,795 | B2 * | 9/2008 | Baxter et al. | 52/718.02 |
| 7,617,638 | B1 | 11/2009 | Slama et al. | |
| 2001/0052205 | A1 * | 12/2001 | Herren | 52/93.1 |
| 2002/0112443 | A1 | 8/2002 | Shipman et al. | |
| 2003/0129940 | A1 * | 7/2003 | Rehbein et al. | 454/276 |
| 2004/0020137 | A1 | 2/2004 | Battey et al. | |
| 2005/0166529 | A1 * | 8/2005 | Rodolofo et al. | 52/716.1 |
| 2005/0262785 | A1 | 12/2005 | Alexander | |
| 2006/0207793 | A1 | 9/2006 | Stempinski | |
| 2007/0113499 | A1 | 5/2007 | Williams | |

FOREIGN PATENT DOCUMENTS

| | | | |
|---|---|---|---|
| EP | 1443160 | A1 | 8/2004 |
| FR | 2520787 | A | 8/1983 |
| GB | 2176219 | A | 12/1986 |
| GB | 2318593 | | 4/1998 |
| WO | 0190507 | | 11/2001 |

OTHER PUBLICATIONS

Sto Corporation, "EIFS NExT 2.00." http://www.stocorp.com/webfiles.nsf/htmlmedia/detaileifs/$file/2.00+next+components.jpg. Jan. 2005.

International Search Report, Mar. 19, 2007 (4 pages).

Copy of drawing titled "Siding Ventilation Detail W/Cor-A-Vent SV-3" dated Feb. 20, 2001. Further information at http://cor-a-vent.com/siding-vent-sv-3.cfm.

* cited by examiner

VENTILATING SPACING STRIP BETWEEN REAR SURFACE OF SIDING AND OUTER SURFACE OF STRUCTURE ALLOWING HORIZONTAL AIR CIRCULATION

CROSS REFERENCE TO RELATED APPLICATION

This application is a Continuation application of patent application Ser. No. 11/365,241 filed Mar. 1, 2006, which is a Continuation-in-Part of patent application Ser. No. 11/297,543 filed Dec. 8, 2005, the contents of which applications are hereby incorporated herein by reference.

FIELD OF THE INVENTION

The present invention relates to structures and methods adapted to provide ventilation between house siding and underlying house structure such as wind and water barrier covered sheathing attached to the outside of framing on the outside wall of the house.

BACKGROUND

It has been found that when certain types of house lap siding, particularly including fiber cement lap siding (e.g., "Hardiplank"® lap siding available from James Hardie Building Products, Mission Viejo, Calif.; or "Weather-Board"™ lap siding available from CertainTeed Corporation, Valley Forge, Pa.), is nailed directly to or over underlying structure such as polymeric house wrap (e.g., "Tyvec"® Home Wrap® available from DuPont) covered sheathing (e.g., sheets of pressboard or plywood) attached to the outside of wood house framing, water can get between the siding and the underlying structure and cause mold to grow therebetween. In some such instances, it has been necessary to remove and replace the siding and parts of the underlying structure to correct that problem.

It is recognized that to alleviate this problem a ventilation space (e.g., a ¼ inch ventilation space) should be provided between the rear surface of the siding and the underlying structure through which ventilation space air can circulate to dry moisture and restrict the growth of mold. Two known methods have been used to provide that ventilation space.

(1) Vertical baton strips (e.g., strips about 2 inches wide and ¼ inch thick) extending vertically from the bottom to the top of the underlying structure, spaced at about 16 inches and aligned with the studs behind the sheathing have been used between the siding and underlying structure to provide such a ventilation space. That ventilation space is only provided between the vertical strips so that horizontal cross ventilation is restricted. Also, nailing the lap siding to those strips can cause visible bows about horizontal axes in the lengths of siding between their upper portions that are nailed to the strips and their lower portions that extend over the upper portions of the lengths of siding below them.

(2) A stiff resiliently flexible corrugated sheet random woven of Nylon polymeric fibers to provide a high percentage of openings through the corrugated sheet (e.g., the "Home Slicker"® corrugated sheet sold by Benjamin Obdyke Incorporated, Horsham, Pa., see U.S. Pat. No. 6,594,965) is positioned between the lengths of siding and the underlying structure with its corrugations extending vertically to provide such a ventilation space. The ventilation space provided by that porous corrugated sheet is somewhat occluded by the presence of the corrugated sheet. Also, nailing the lengths of siding to the underlying structure through the corrugated sheet can collapse the corrugations in the sheet under the nailed portions of the siding, whereas the portions of the siding between the nailed portions are held away from the underlayment by the corrugated sheet, thereby causing visible bows in the siding about vertical axes between those nailed portions.

DISCLOSURE OF THE INVENTION

The present invention provides specially shaped spacers and a method for using such spacers between an underlying structure on the outside wall of a building and each of the portions of lengths of lap siding through which the lengths of siding are nailed to the underlying structure to provide a ventilation space between the rear surfaces of the lengths of siding and the underlying structure while restricting visible bowing the lengths of siding; and also provides a building comprising an outside wall that can be made by that method and which can include novel means for opening the ventilation space to the atmosphere at its upper and lower ends.

The spacers according to the present invention each have a rear surface or rear surfaces generally in and defining a first plane, which rear surface or rear surfaces are adapted to be positioned against the generally planar outer surface of an underlying structure (e.g., an outer surface formed by polymeric house wrap covered sheathing), and a front support surface or support surfaces generally in and defining a second plane on the side of the spacer opposite the first plane, which second plane can be disposed at a small acute angle (e.g., in the range of about 1.5 to 4 degrees or about 2 to 3 degrees for use with lengths of siding in the range of about 6¼ inches or 15.8 cm to 12 inches or 30.5 cm wide) with respect to the first plane defined by the rear surface or rear surfaces, at which small acute angle it is desired to have the rear surfaces of the lengths of siding disposed with respect to the outer surface of the underlying structure. The second plane defined by the support surface or support surfaces can diverge away from the first plane defined by the rear surface or rear surfaces at that angle from a first or upper edge of the second plane defined by the support surface or support surfaces toward a second or lower edge of that second plane. The spacer has a predetermined thickness (e.g., about ¼ inch) between the first and second planes at the upper edge of the second plane. That predetermined thickness defines the minimum dimension of the ventilation space that the spacer will provide between the outer surface of the underlying structure and the inner surfaces of the lengths of siding.

The spacers each include a projecting portion having a stop surface at and projecting above the first or upper edge of the second plane defined by the support surface or support surfaces. The projecting portion can facilitate manual engagement with the spacer while the spacer is positioned behind a length of siding or inserted between a length of siding and the underlying structure, and helps locate the spacer or stops such insertion when the stop surface contacts the upper edge of the length of siding. The projecting portion extends from the stop surface to a top end of the spacer and projects above the first or upper edge of the plane defined by the support surface or support surface portions a distance (e.g., 5/16 inch or 0.79 cm) about equal to or less than the thickness of the lengths of siding along their upper edges.

The spacers can also each include a tapered portion extending from the second or lower edge of the second plane defined by the support surface or support surfaces to a bottom end of the spacer, which tapered portion has a front wedge surface or wedge surfaces on the side of the spacer opposite the rear surface or rear surfaces and disposed generally in and defining a third plane that converges away from that second edge toward the first plane defined by the rear surface or rear surfaces at an acute angle (e.g., about 20 degrees) between the first and third planes. The tapered portion provides a wedge which can facilitate inserting the spacer between the rear surface of a length of siding and the outer surface of the underlying structure.

A method for using the spacers to provide a ventilation space between lengths of siding and the underlying structure of a house can include positioning the spacers between the rear surfaces of the lengths of siding and the underlying structure with their support surfaces against the rear surfaces of the lengths of siding, their stop surfaces contacting the upper edges of the lengths of siding behind which the spacers are positioned, with the rear surfaces of the spacers against the outer surface of the underlying structure, and with the spacers for each of the lengths of siding spaced (e.g., at about 16 inches) along its length in alignment over the side surfaces of building structure (e.g., wood 2×4s) included in the underlying structure over which they are positioned. Each length of siding is attached by fasteners (e.g., nails or screws) driven through the upper portion of the length of siding, the spacers generally centrally of the second plane defined by their support surfaces, and into the underlying structure. This can position each of the lengths of siding so that the rear surfaces of the lengths of siding diverge away from the adjacent outer surface of the underlying structure at a slight angle with the rear surfaces of the lengths of siding at their top edges spaced at a predetermined distance (e.g., about ¼ inch) from the underlying structure, and with portions of the lengths of siding adjacent their lower edges laying against and pressed slightly against the outer surface of an upper portion of the length of siding below them. This can be done without visual bending the siding by appropriate selection of the angle between the first and second planes defined by the rear surfaces and support surfaces of the spacers for the width and thickness of the length of siding being attached.

The spacers can have lengths between their top and bottom ends that are significantly less (e.g., preferably no more that about ½) the widths of the lengths of siding with which they are used so that there is a space between vertically aligned spacers used to attach the lengths of siding. Thus the ventilation space provided by the spacers between the underlying structure and the lengths of siding can afford movement of air and moisture in both horizontal and vertical directions in the ventilation space.

The spacer should be made of a material that can firmly support and retain the positions of the lengths of siding for the life of the building, that can be nailed through with relative ease either with a power nailing device or manually with a hammer, and that will not split when it is nailed through over the range of temperatures in which house construction occurs (e.g., −30 to 120 degrees F. or −34 to 49 degrees C.). Suitable materials may include, but are not limited to, fibrous or polymeric materials or composites thereof, such as wood (preferably coated to restrict absorbing moisture), PVC, ABS, polypropylene, or glass reinforced high or low melt resins. One material that may be acceptable for molding the spaces is the polypropylene copolymer, material grade PD852360 commercially available from Bassel Polyolefins, web address www.Montel.com. When appropriate for the material used, the spacer can be cut or machined from a larger block of such material, can be made by a combination of extrusion and transverse cutting, or can be injection or vacuum molded.

The spacer can have a continuous front support surface that provides support centrally across the second plane defined by its support surface or surfaces so that it provides support for the rear surface of a length of siding around a fastener (e.g., a nail) as that fastener is driven through that length of siding, the spacer, and into the underlying structure. Such support for the rear surface of the length of siding restricts portions of the siding around that fastener along the rear surface of the siding from being broken out by movement of the fastener through the length of siding. Alternatively, if the material from which the length of siding is made does not need such support, the spacer can have a passageway that extends through the center of the second plane defined by the support surface or support surfaces through which passageway that fastener can pass so that the spacer causes little or no increase in the force needed to insert that fastener through the length of siding and spacer and into the underlying structure compared to fastening the length of siding to the underlying structure without the spacer.

Use of the spacers can provide an outer wall for a building in which a multiplicity of the spacers between a planar outer surface of an underlying structure of the wall and the rear surfaces of the lengths of siding through which spacer the lengths of siding are fastened to the underlying structure provide a ventilation space between the lengths of siding and the underlying structure.

The outer wall can further include ventilation means which can include a lower ventilation channel between the rear surface of the lowermost portion of the lowermost length of siding and the planar outer surface of the underlying wall structure across the lower open end of the ventilation space, and an upper ventilation channel between the length or lengths of siding and a lower surface on the building, which channels have openings communicating with the lower and upper ends of the ventilation space and have openings to the atmosphere. Air can freely move in either direction through the lower ventilations channel, the ventilation space between the rear surfaces of the lengths of overlap siding and the underlying structure of the building, and through the upper ventilation channel.

The lower and upper ventilation channels can also be useful in an outer wall for a building that has siding other than lap siding, such as siding of stucco or sheets of wood or another suitable material, where that outer wall includes an underlying structure having a vertical outer surface; and means are provided for supporting the siding on the underlying structure with a rear surface on the siding spaced from the outer surface of the underlying structure to provide a ventilation space between the siding and the underlying structure having openings both at the lower end and at the upper end of the siding. The lower ventilation channel can then be used between the inner surface of the siding and the outer surface of the underlying structure across the lower opening to the ventilation space at the lower end of the siding; and the upper ventilation channel can then be used between the uppermost edge of the siding and a lower horizontal surface on the building (e.g., a lower surface on a freeze board, soffit, eave or overhang) across the upper end of the ventilation space.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
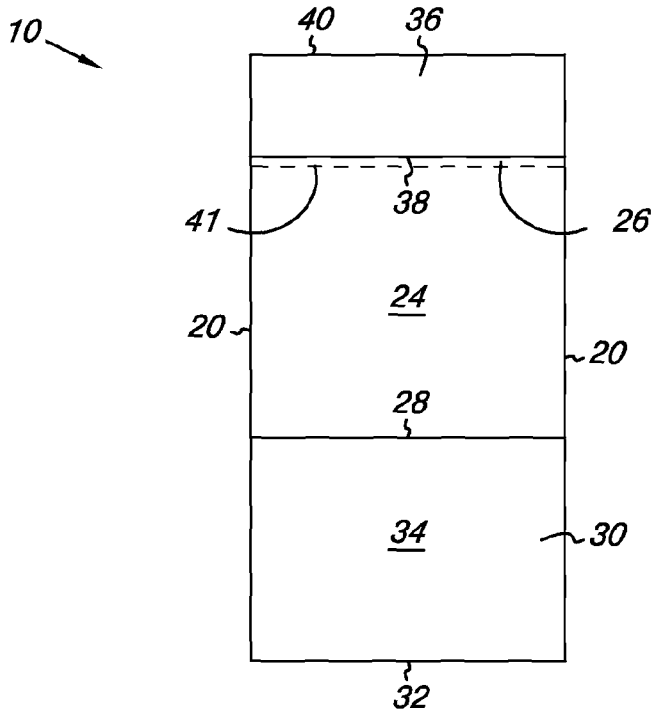
FIG. 1 is a front view of a first embodiment of a spacer according to the present invention.

With reference to FIGS. 1, 2, 3, 4, and 4*a* of the drawing, the present invention comprises specially shaped spacers 10 adapted to be used between a generally planar vertical outer surface on an underlying structure 11 of an outer sidewall of a building 13 and each of the portions of lengths of siding 16, through which spacers 10 the lengths of siding 16 are fastened to the underlying structure 11 to provide a ventilation space 9 between the inner or rear surfaces of the lengths of siding 16 and the vertical outer surface of the underlying structure 11. Use of the spacers 10 to provide that ventilation space 9 can afford movement of air in any direction in that ventilation space 9 and can restrict visible bowing of the lengths of siding 16.

Figure 2:
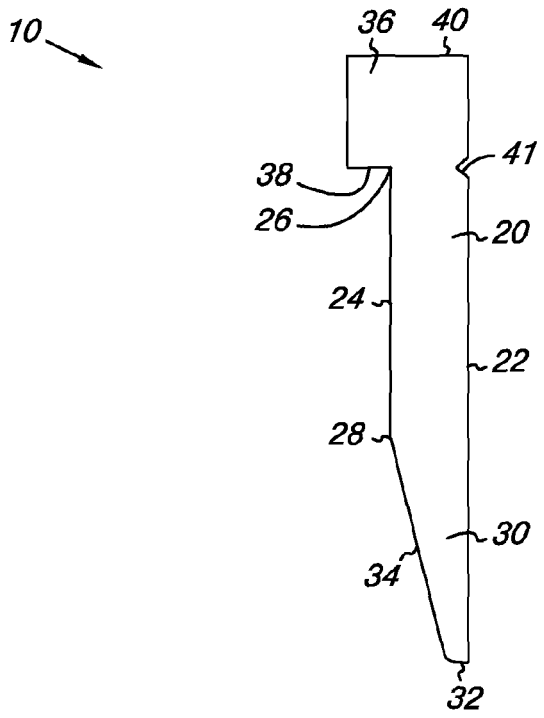
FIG. 2 is a right side view of the spacer of FIG. 1.
Figure 3:
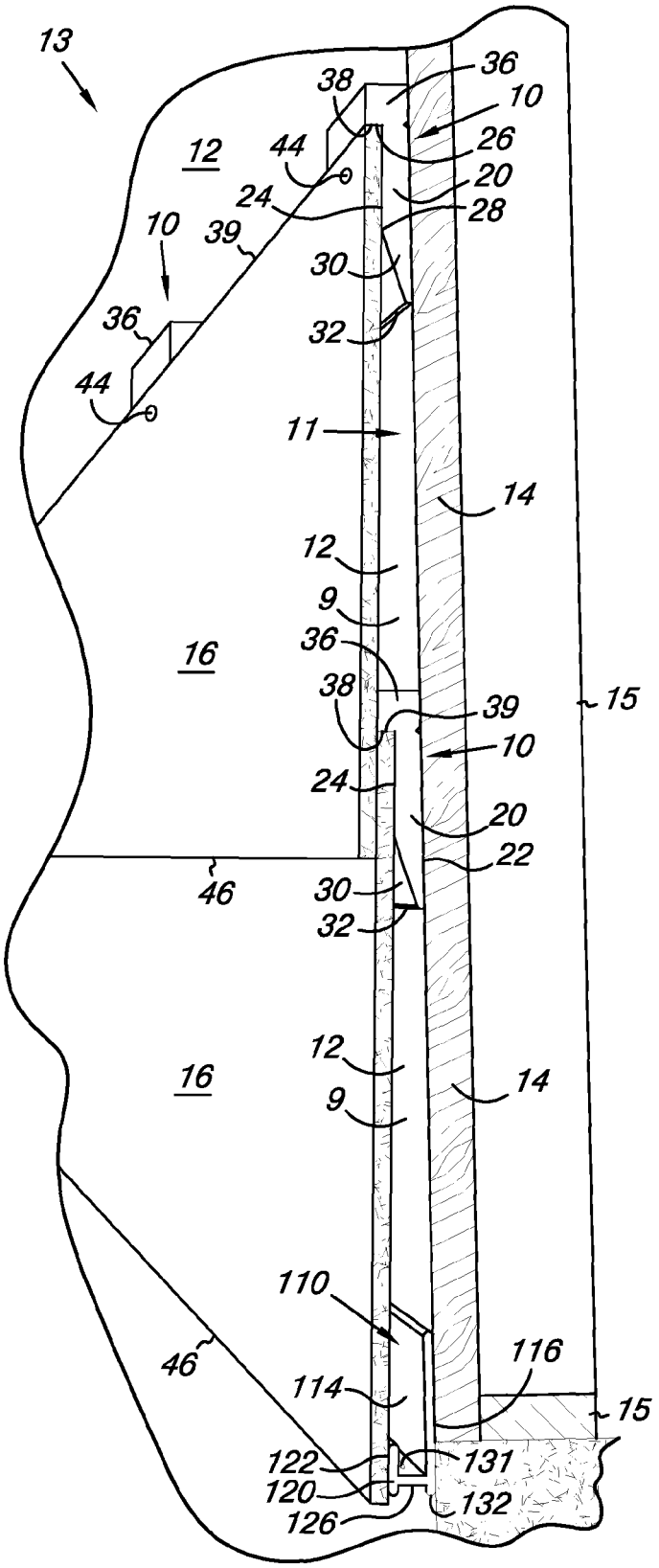
FIG. 3 is a fragmentary perspective view having parts broken away to show details that illustrates the use of spacers of the type illustrated in FIG. 1 to attach lengths of siding to an underlying structure of an outer wall of a building to form a ventilation space between an outer surface of the underlying structure and the rear surface of the lengths of siding and also illustrates the use of a lower ventilation channel across the lower end of the ventilation space.
Figure 4:
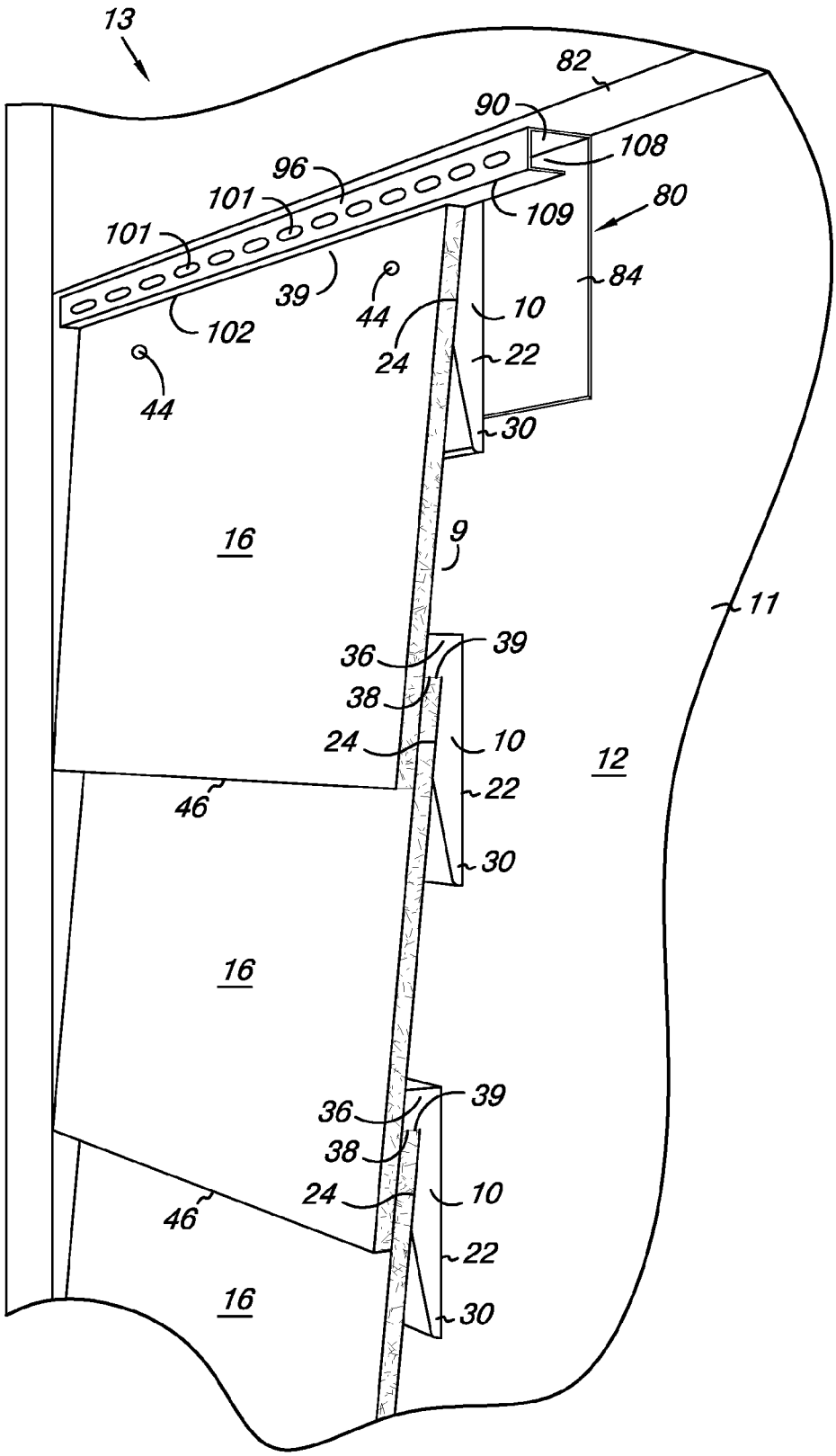
FIG. 4 is a fragmentary perspective view having parts broken away to show details that illustrates the use of spacers of the type illustrated in FIGS. 1 and 2 to attach lengths of siding to an underlying structure of an outer wall of a building and also illustrates the use of an upper ventilation channel between the uppermost edge of the uppermost length of siding and a lower horizontal surface on the building.
Figure 4A:
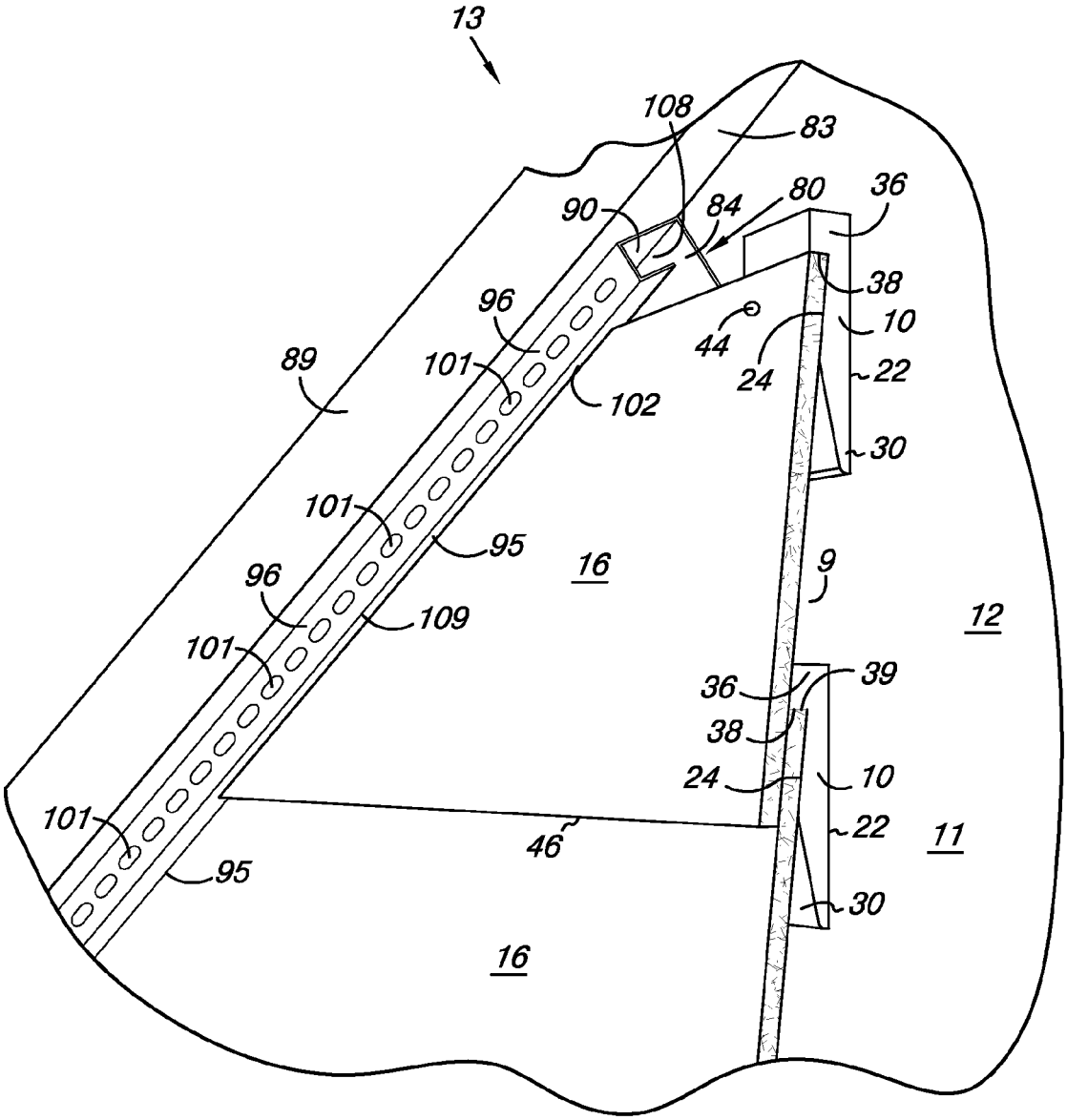
FIG. 4*a* is a fragmentary perspective view having parts broken away to show details that illustrates the use of spacers of the type illustrated in FIGS. 1 and 2 to attach lengths of siding to an underlying structure of an outer wall of a building and also illustrates the use of an upper ventilation channel between ends of the lengths of siding and a lower inclined surface on the building.

FIGS. 1 and 2 illustrate one of the spacers 10. FIGS. 3, 4, and 4*a* illustrate use of the spacers 10 to attach lengths of siding 16 (e.g., fiber cement lap siding such as "Hardiplank"® lap siding available from James Hardie Building Products, Mission Viejo, Calif., or "WeatherBoard"™ lap siding available from CertainTeed Corporation, Valley Forge, Pa.) to an underlying structure 11, which underlying structure 11 as illustrated comprises polymeric air and water barrier water vapor permeable house wrap 12 (e.g., "Tyvec"® house wrap) covering plywood or press-board sheathing 14 over 2×4 wood building framing 15. The spacers 10 each have a width (e.g., about 1.5 inches or 3.8 cm) between parallel side surfaces 20 that can be about the same as the width of the side surface of the 2×4 wood framing 15 in the underlying structure 11 with which they will be aligned, and a rear surface 22 generally in and defining a first plane, which rear surface 22 is adapted to be positioned against the generally planar vertical outer surface of the underlying structure 11 (e.g., against the outer surface of the polymeric house wrap 12 covering the sheathing 14). The spacers 10 each also have a continuous front support surface 24 generally in and defining a second plane on the side of the spacer 10 opposite the rear surface 22, which second plane and support surface 24 are disposed at a small acute angle (i.e., in the range of about 1.5 to 4 degrees and preferably in the range of about 2 to 3 degrees for lengths of siding in the range of about 6¼ inches or 15.8 cm to 12 inches or 30.5 cm wide) with respect to the first plane and rear surface 22, at which small acute angle it is desired to have the rear surfaces of the lengths of siding 16 disposed with respect to the vertical outer surface of the underlying structure 11. The second plane defined by the support surface 24 diverges away from the first plane defined by the rear surface 22 at that small acute angle from a first or upper edge 26 of the support surface 24 and the second plane defined by the support surface 24 toward a second or lower edge 28 of the second plane and the support surface 24. The spacer 10 has a predetermined thickness (e.g., about ¼ inch) between the second plane defined by its support surface 24 and the first plane defined by its rear surface 22 at and along the first edge 26, which predetermined thickness defines the minimum dimension of the ventilation space 9 that the spacer 10 will provide between the underlying structure 11 and the lengths of siding 16.

The spacers 10 each include a projecting portion 36 having a stop surface 38 at the first edge 26 of and projecting above second plane defined by the support surface 24. The stop surface 38, as illustrated, is disposed at about a right angle with respect to the second plane defined by the support surface 24, but could alternatively be disposed at a different angle. The stop surface 38 facilitates alignment of the first edge 26 of the second plane and support surface 24 with a top edge surface 39 of one of the lengths of siding 16. The projecting portion 36 facilitates manual engagement with the spacer 10 when the spacer 10 is positioned along the rear surface of one of the lengths of siding 16 before the length of siding 16 is attached to the underlying structure 11 and when the spacer 10 is inserted between the rear surface of a length of siding 16 and the underlying structure 11 after the ends of the that length of siding 16 are already attached to the underlying structure 11 through two spacers 10 each adjacent a different one of its ends, whereupon such insertion will be stopped when the stop surface 38 contacts the top edge surface 39 of the length of siding 16. The projecting portion 36 extends from the stop surface 38 to a top end 40 of the spacer 10 and projects above the first edge 26 of the second plane defined by the support surface 24 a distance no greater than the thickness along the top edge surfaces 39 of the lengths of siding 16 with which the spacer 10 is intended to be used (e.g., typically a distance of about 5/16 inch or 0.79 cm or less).

The spacers 10 optionally can each include a tapered portion 30 extending from the second edge 28 of the second plane defined by the support surface 24 to a bottom end 32 of the spacer 10. That tapered portion 30 has a front wedge surface 34 on the side of the spacer 10 opposite the rear surface 22 disposed generally in a third plane that diverges away from the second edge 28 of the second plane toward the bottom end 32 and the first plane defined by the rear surface 22 at an acute angle (e.g., about 20 degrees) between the front wedge and rear surfaces 34 and 22. The front wedge and rear surfaces 34 and 22 along the tapered portion 30 form a wedge that can facilitate inserting the spacer 10 between the siding 16 and the underlying structure 11.

The spacer 10 can, as illustrated, optionally have a transverse groove 41 recessed from the first plane defined by its rear surface 22 and aligned with the first edge 26 of the second plane defined by the support surface 24, or could alternatively have a transverse groove recessed from the second plane defined by its support surface 24 along the first edge 26 (not shown). Either of such grooves affords breaking the spacer 10 along the groove 41 to separate the projecting portion 36 from a portion of the spacer 10 between the first edge 26 and the bottom end 32 of the spacer 10. Such breaking away of the projecting portion 36 can facilitate using that portion of the spacer 10 between the uppermost length of siding 16 along an underlying structure 11 and the freeze board or soffit, eave, or overhang of a house so that the top edge surface 39 of that uppermost length of siding 16 can be positioned against the bottom surface of that freeze board or soffit, eave, or overhang.

The spacer 10 can also have a plurality of parallel spaced transverse recesses (not shown) from the plane defining its planar rear surface 22 and extending either from the bottom end 32 to the top end 40 of the spacer 10 or between the side surfaces 20 of the spacer 10 to afford movement of air and water between the spacer 10 and the planar outer surface of the underlying structure 11 against which the rear surface 22 of the spacer 10 is positioned.

The width of the spacer 10 between its side surfaces 20 should be at least 1 inch or 2.54 cm which about corresponds to the width of the shoes on many power nailing devices to thereby facilitate aligning that shoe with the spacer 10. That width preferably is about 1.5 inch or 3.8 cm which about corresponds to the side surface dimension of 2×4 wood framing over which the spacer 10 is often aligned, and should not need to be much wider (e.g., less than about 2 inch or 5 cm) so that it does not occupy too much the ventilation space 9 it forms between the lengths of siding 16 and the underlying structure 11. The thickness of the spacer 10 at and along the first edge 26 of the second plane defining the support surface 24 should be at least about ⅛ inch or 0.32 cm so that it will form a minimum ventilation space 9 through which air and water can pass of about ⅛ inch or 0.32 cm between the inner surfaces of the lengths of siding 16 and the outer surface of the underlying structure 11. That thickness preferably is in the range of about ¼ to ⅜ inch or 0.64 to 0.95 cm to provide a minimum ventilation space through which air and water can more freely pass of about ¼ to ⅜ inch or 0.64 to 0.95 cm thick between the lengths of siding 16 and the underlying structure 11. That thickness could be, but should not need to be, more than about ½ inch or 1.3 cm. The dimension of the second plane defined by the support surface 24 between its first edge 26 and its second edge 28 should be in the range of 1 to 2 inches or 2.54 to 5 cm (e.g., about 1.5 inch or 3.8 cm) to provide firm support for the length of siding 16 the spacer 10 spaces from the underlying structure 11.

As can be seen in FIGS. 3, 4, and 4*a*, the spacers 10 can be positioned between the inner surfaces of the lengths of siding 16 and the outer surface of the polymeric air and water barrier housewrap 12 included in the underlying structure 11 with the stop surfaces 38 of the spacers 10 contacting the top edge surfaces 39 of the lengths of siding 16. Spacers 10 for each of the lengths of siding 16 can be spaced (e.g., at about 16 inches) along its length in alignment over the side surfaces of framing 15 (e.g., wood 2×4s) included in the underlying structure 11. Each length of siding 16 is attached by fasteners 44 (e.g., nails or screws) extending through the upper portion of the length of siding 16, through the spacers 10 generally centrally of the second planes defined by their support surfaces 24, and into the underlying structure 11. This will position each of the lengths of siding 16 so that the rear surfaces of the lengths of siding 16 diverge away from the adjacent planar vertical outer surface of the underlying structure 11 at a slight angle so that at the top edges 39 of the lengths of siding 16 the rear surfaces of the lengths of siding 16 are spaced at a predetermined distance (e.g., ¼ inch) from the outer surface of the underlying structure 11, and so that a portion of each length of siding 16 adjacent its lower edge lays and is pressed against the outer surface of an upper portion of the length of siding 16 directly below it. This is done without significantly bending the siding 16 when it is fastened to the underlying structure 11 by appropriate selection of the angle between the first and second planes defined by the rear surfaces 22 and support surfaces 24 of the spacers 10 for the width and thickness of the siding 16 being attached. Too large an angle will cause that portion of each length of siding 16 adjacent its lower edge to be spaced from the outer surface of an upper portion of the length of siding 16 directly below it, which is undesirable. Too small an angle can cause that portion of each length of siding 16 adjacent its lower edge to be pressed with sufficient force against the outer surface of an upper portion of the length of siding 16 directly below it so that a visible bow about a horizontal axes can be caused in the length of siding 16 between its upper portion that is nailed to the underlying structure 11 through the spacer 10 and its lower portion that is pressed against and supported on the upper portion of the length of siding below it. Such visible bowing is also undesirable. An angle between the first and second planes defined by the rear surfaces 22 and support surfaces 24 of the spacers 10 in the range of about 1.5 to 4 degrees and preferably in the range of about 2 to 3 degrees for lengths of siding in the range of about 6¼ inches or 15.8 cm to 12 inches or 30.5 cm wide and 5/16 inch or 0.8 cm thick have been found to restrict both such spacing between and significant visual bowing of overlapped lengths of siding 16. The use of significantly narrower, wider, and/or thicker lengths of siding could possibly change the preferred angle between the first and second planes defined by the rear surfaces 22 and support surfaces 24 of the spacers 10.

Also, as can be seen in FIGS. 3, 4 and 4*a*, the spacers 10 have lengths between their top and bottom ends 40 and 32 that are significantly less (e.g., no more that about ½) the widths of the lengths of siding 16 with which they are intended to be used (e.g., a spacer 10 length of less than about 3.5 inches or 9 cm for lengths of siding 16 having a width of 8¼ inch or 20.3 cm, or a spacer 10 length of less than about 2.5 inches or 6.4 cm for lengths of siding 16 having a width of 6¼ inch or 15.2 cm) so that there is a significant space between vertically aligned spacers 10 used to attach the lengths of siding 16. Thus the ventilation space 9 provided by the spacers 10 between the underlying structure 11 and the lengths of siding 16 affords movement of air in both horizontal and vertical directions in the ventilation space 9 between the lengths of siding 16 and the underlying structure 11.

A method for using the spacers 10 to sequentially attach each length of siding 16 over the underlying structure 11 of the outer sidewall of the building 13 from the lowermost length of siding 16 to the uppermost length of siding 16 to provide the ventilation space 9 between the lengths of siding 16 and the underlying structure 11 can include positioning the support surfaces 24 of the spacers 10 in spaced relationship along the rear surface of the lowermost length of siding 16 with the top edge surface 39 of the length of siding 16 along the stop surface 38 at the first edge 26 of the first plane defined by the support surface 24 of each spacer 10; and at each spacer 10 driving a fastener 44 (e.g., a nail or screw) through the length of siding 16, generally centrally through the second plane defined by the support surface 24 of the spacer 10 and into the underlying structure 11. Such positioning can be done by first positioning the support surfaces 24 of two of the spacers 10 along the rear surface of the length of siding 16 each adjacent a different one of its opposite ends typically in alignment with vertical members of the framing in the underlying structure 11; and then at each spacer 10 driving a fastener 44 through the length of siding 16, through the spacer 10 generally centrally along its second plane defined by its support surface 24 and into the underlying structure 11. Subsequently additional spacers are inserted at spaced relationships (i.e., typically in alignment with vertical members of the framing in the underlying structure 11) between the rear surface of the length of siding 16 and the underlying structure 11 by pressing each spacer 10 between the length of siding 16 and the underlying structure 11 with the bottom end 32 of the tapered portion 30 leading until the stop edge surface 38 of each spacer 10 is along and contacts the top edge surface 39 of the length of siding 16, after which fasteners 44 are driven through the length of siding 16, the second plane defined by the support surface 24 of each of those spacers 10 and into the underlying structure 11. After the lowermost length of siding 16 is attached, lengths of siding 16 above it can be sequentially attached in the same way after being located with respect to the length of siding 16 below them.

That method can be used to make the outer wall of the building 13 having the underlying structure 11 with the generally planar vertical outer surface; a plurality of the lengths of elongate siding 16 each having generally planar opposite front and rear surfaces extending between longitudinally extending opposite top and lower edge surfaces 39 and 46, the lengths of siding 16 being disposed with their rear surfaces adjacent the outer surface of the underlying structure 11 in parallel overlapping relationship with upper portions of the front surfaces of the lengths of siding 16 disposed along lower portions of the rear surfaces of adjacent lengths of siding 16; and a multiplicity of the spacers 10 spaced along each of the lengths of siding 16 between the planar vertical outer surface of the underlying structure 11 and the rear surfaces of the lengths of siding 16 through which spacers 10 the lengths of siding 16 are fastened to the underlying structure 11 to provide the ventilation space 9 between the lengths of siding 16 and the underlying structure 11.

Figure 5:
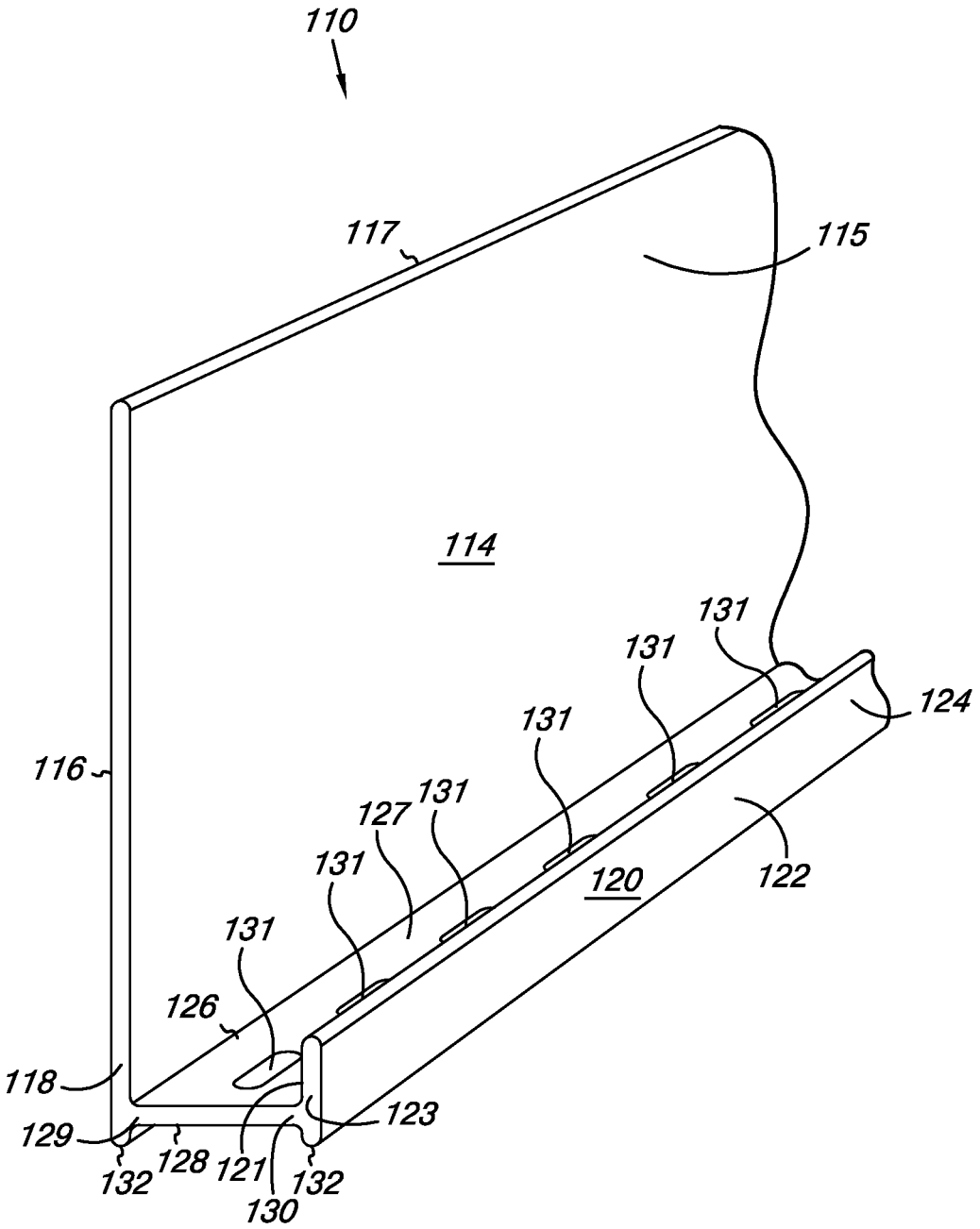
FIG. 5 is an enlarged perspective view of the lower ventilation channel used in FIG. 3.

The outer sidewall of the building 13 can, as illustrated in FIG. 3 (and as a preferred alternative to the ventilation strip 42 described in U.S. patent application Ser. No. 11/297,543 filed Dec. 8, 2005, of which this application is a Continuation-in-Part), include a novel lower ventilation channel 110 between a lower portion of the lowermost length of siding 16 and an adjacent portion of the vertical outer surface of the underlying structure 11 of the outer wall of the building 13. The lower ventilation channel 110, shown removed from the building 13 in FIG. 5, can be formed of metal (e.g., aluminum) by sheet metal stamping and bending equipment, or can be an extrusion formed of polymeric material (e.g., ABS) using extrusion, stamping and cutting equipment. The lower ventilation channel 110 has wall portions (e.g., each about 0.045 inch or 0.11 cm thick) including an elongate planar innermost wall portion 114 having inner and outer major surfaces 115 and 116 extending between opposite first and second longitudinally extending edges 117 and 118 (e.g., about 2.05 inch or 5.2 centimeters wide between its edges 117 and 118) and, as illustrated in FIG. 3, can have its outer major surface 116 positioned against the vertical outer surface of the underlying structure 11 of the outer wall of the building 13. The wall portions of the ventilation channel 110 also include an elongate generally planar outer wall portion 120 having inner and outer major surfaces 121 and 122 extending between opposite first and second longitudinally extending edges 123 and 124. The outer wall portion 120 is generally parallel to and is significantly narrower than the innermost wall portion 114 (e.g., about 0.33 inch or 0.84 centimeters wide between its edges or at least 0.75 or 1 inches or 1.9 to 2.54 cm narrower to facilitate nailing through the inner surface 115 of the innermost wall portion 114). As illustrated in FIG. 3, the outer wall portion 120 can have its outer major surface 122 positioned against the generally vertical inner surface of a lower portion of the lowermost length of siding 16 with its first edge 123 parallel to and a short distance (e.g., 0.5 inch or 1.3 cm) above the bottom edge 46 of that length of siding 16. The wall portions of the ventilation channel 110 further include an elongate perforate wall portion 126 having inner and outer major surfaces 127 and 128 extending between opposite first and second longitudinally extending edges 129 and 130 (e.g., about 0.46 inch or 1.17 centimeters wide between its edges 129 and 130 and having a width in the range of 0.5 to 1 inch or 1.8 to 2.5 cm). The first edge 129 of the perforate wall portion 126 is joined to the outer wall portion 114 at its second edge 118, the second edge 130 of the perforate wall portion 126 is joined to the innermost wall portion 120 at its first edge 123, and the perforate wall portion 126 extends between the inner surfaces 115 and 121 of the innermost and outer wall portions 114 and 120 with the surfaces 127 and 128 of the perforate wall portion 126 at about right angles with respect to the outer surfaces 116 and 122 of the innermost and outer wall portions 114 and 120 and with the inner surfaces 115, 121, and 127 of the wall portions 114, 120, and 126 adjacent. The perforate wall portion 126 has through openings such as a row of small through openings 131 as illustrated between its inner and outer surfaces 127 and 128 and along its length. The lower ventilation channel 110 includes spaced parallel ribs or lips 132 that project a short distance (e.g., 0.05 inch or 0.13 cm) from the junctures between the perforate wall portion 126 and the outer and innermost wall portions 114 and 120. Those ribs 132 provide drip edges for liquid moisture that may pass through the openings 131 or may otherwise be deposited on the outer surface 128 of the perforate wall portion 126. The ventilation channel 110 should include means for restrict movement of insects through the openings 131 in the perforate wall portion 126, which means can comprise making the openings 131 a small size that affords the passage of air and moisture, but is sufficiently small to restrict movement of insects through the openings 131 (e.g., openings 131 about 0.5 inch or 1.27 cm long and 0.1 inch or 0.3 cm wide spaced by about 0.5 inch or 1.27 cm along its length). Other means could be provided for restricting entrance of insects through openings through the perforate wall portion 126 such as window screen or a layer of the type of material sold under the trade designation "Cobra® Exhaust Vent for Roof Ridge" commercially available from GAF Materials Corporation, in which case the openings 131 could be of a larger size and/or different shape.

The surfaces 127 and 128 of the perforate wall portion 126 are illustrated as being generally planar, however, they could have other contours between its first and second edges 129 and 130 such as being arcuate, preferably with its inner surface 127 concave. With the ventilation channel 110 positioned in the outer wall of the building 13 as illustrated in FIG. 4, air can flow into or out of the ventilation space 12 through the openings 131 in the lower ventilation channel 110. The ventilation channel 110 can, as illustrated in FIG. 3, be attached generally horizontally along the lowermost portion of the underlying structure 11 of the building 13 in the desired location by fastening it along or through its innermost wall portion 114 (e.g., with nails, screws, or adhesive); after which when siding is attached to the underlying structure such as the lowermost length of siding 16 attached to the underlying structure 11 using the spacers 10 in the manner described above and illustrated in FIG. 3, the inner surface of that lowermost length of siding 16 will be pressed against the outer surface 122 of the outer wall portion 120. The outer surfaces 116 and 122 of the innermost and outer wall portions 114 and 120 may converge slightly (e.g., in the range of 2 to 3 degrees) from their second and first edges 118 and 123 toward their first and second edges 117 and 124 to correspond to the angle between the inner surface of the lowermost length of siding and the outer surface of the underlying structure 11 of the outer wall of the building 13.

Figure 6:
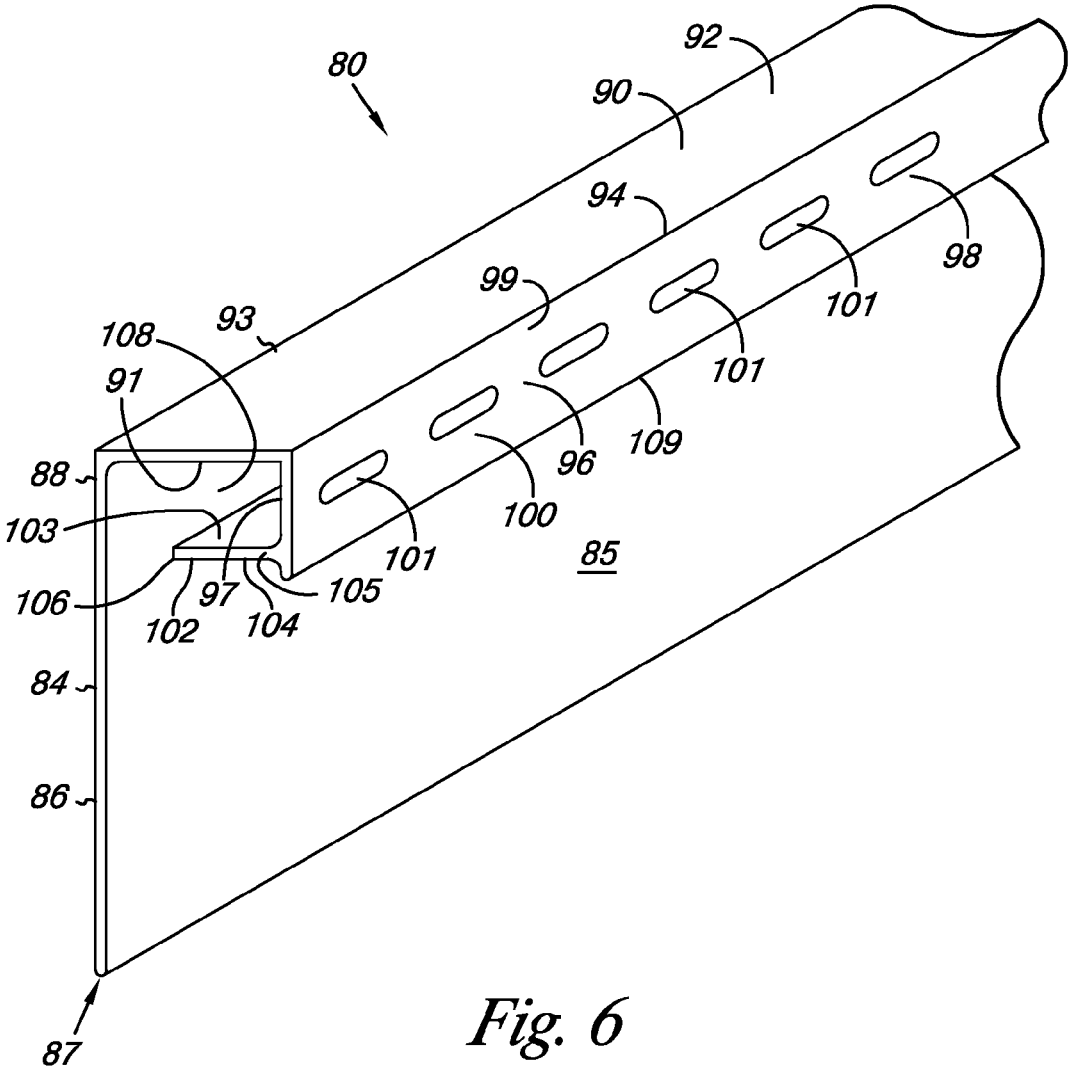
FIG. 6 is an enlarged perspective view of the upper ventilation channel used in FIG. 4.

The outer sidewall of the building 13 can, as illustrated in FIG. 4, further include a novel upper ventilation channel 80 between the uppermost edge 39 of the uppermost length of siding 16 and a lower horizontal surface 82 on the building 13. The upper ventilation channel 80, shown removed from the building 13 in FIG. 6, can be formed of metal (e.g., aluminum) by sheet metal stamping and bending equipment, or can be an extrusion formed of polymeric material (e.g., ABS) using extrusion, cutting, and stamping equipment. The upper ventilation channel 80 has wall portions including an elongate planar inner wall portion 84 having inner and outer major surfaces 85 and 86 extending between opposite first and second longitudinally extending edges 87 and 88 (e.g., about 1.75 inches or 4.45 centimeters wide) and, as illustrated in FIG. 4, can have its outer major surface 86 positioned against the vertical outer surface of the underlying structure 11 of the outer wall of the building 13. The wall portions of the upper ventilation channel 80 also include an elongate generally planar upper wall portion 90 having inner and outer major surfaces 91 and 92 extending between opposite first and second longitudinally extending edges 93 and 94 (e.g., about 0.87 inch or 2 centimeters wide). The first edge 93 of the upper wall portion 90 is joined to the second edge 88 of the inner wall portion 84, and the upper wall portion 90 is disposed at about a right angle with respect to the inner wall portion 84 with the inner surfaces 85 and 91 of the wall portions 84 and 90 adjacent. The outer surface 92 of the upper wall portion 90 can be positioned against a lower surface on the building 13. That lower surface can, as illustrated in FIG. 4, be the lower horizontal surface 82 on a freeze board or on a soffit, eave, or on an overhang on the building 13 along and above the uppermost edge 39 of the uppermost length of siding 16, or, as illustrated in FIG. **4*a* can be an inclined lower surface 83 of a freeze board or overhang 89 extending toward the peak on an outer wall of the building 13**.

The wall portions of the upper ventilation channel 80 also include an elongate lower wall portion 102 having inner and outer major surfaces 103 and 104 extending between opposite first and second longitudinally extending edges 105 and 106 (e.g., about 0.535 inch or 1.36 centimeters wide). The lower wall portion 102 is disposed generally parallel to the upper wall portion 90 with the inner surfaces 91 and 103 of the upper and lower wall portions 90 and 102 adjacent and spaced apart (e.g., by about 0.54 inch or 1.37 cm). The second edge 106 of the lower wall portion 102 is spaced from the inner wall portion 84 by about the minimum dimension of the ventilation space 9 between the outer surface of the underlying structure 11 and the inner surfaces of the lengths of siding 16 (e.g., in the range of about ⅛ inch or 0.3 cm to ½ inch or 1.3 cm such as about 0.29 inch or 0.74 cm). The outer surface 104 of the lower wall portion 102 can, as illustrated in FIG. 4, be positioned against the upper edge 39 of the uppermost length of the lapped siding 16, or as illustrated in FIG. **4*a* can be positioned against the ends 95 of lengths of siding 16*a* adjacent the inclined lower surface 83 of the freeze board or overhang 89. The lower wall portion 102 is illustrated as being planar, however, it could have other generally planar contours between its first and second edges 105 and 106 such as a contour that corresponds to the upper edge 39 of the uppermost length of siding 16 or ends of the lengths of siding 16*a*. The wall portions of the upper ventilation channel 80 further include an elongate perforated wall portion 96 having inner and outer major surfaces 97 and 98 extending between opposite first and second longitudinally extending edges 99 and 100 (e.g., about 0.63 inch or 1.6 centimeters wide). The first edge 99 of the perforated wall portion 96 is joined to the second edge 94 of the upper wall portion 90, and the second edge 100 of the perforated wall portion 96 is joined to the first edge 105 of the lower wall portion 102. The perforated wall portion 96 is disposed at about a right angle with respect to the upper and lower wall portions 90 and 102 with the inner surfaces 91, 97, and 103 of the wall portions 90, 96 and 102 adjacent, and the upper ventilation channel 80 has through openings such as a row of through openings 101 as illustrated between the inner and outer surfaces 97 and 98 of the perforated wall portion 96 along the length of the perforated wall portion 96 and generally centrally between its edges 99 and 100. The upper ventilation channel 80 should include means for restricting movement of insects through the openings 101 in the perforated wall portion 96 which means can comprise making the openings 101 through the perforated wall portion 96 of small sizes that afford the passage of air, but are sufficiently small to restrict movement of insects through the openings 101 (e.g., openings 101 about 0.5 inch or 1.3 cm long and about 0.1 inch or 0.3 cm wide spaced by about 0.5 inch or 1.3 cm along its length). Other means could be provided for restricting entrance of insects through openings 101 through the perforated wall portion 96 such as window screen or a layer of the type of material sold under the trade designation "Cobra® Exhaust Vent for Roof Ridge" commercially available from GAF Materials Corporation extending across those openings 101, which openings 101 could then be of a larger size and/or different shape. The outer surface 98 of the perforated wall portion 96 can be coated or co-extruded with a layer of material (e.g., PVC) that allows it to be painted. The perforated wall portion 96 is illustrated as being generally planar; however, it could have other contours between its first and second edges 99 and 100** such as being arcuate.

With the upper ventilation channel 80 positioned in the outer wall of the building 13 as illustrated in FIGS. 4 and **4*a*, the space between the second edge 106 of the lower wall portion 102 and the inner wall portion 84 and the space between the inner surfaces 91 and 103 of the upper and lower wall portions 90 and 102 afford communication between the open upper end of the ventilation space 9 and a chamber 108 defined by the inner surfaces 85, 91, 97, and 103 of the upper ventilation channel 80; and that chamber 108 communicates with the atmosphere through the openings 101 in the perforated wall portion 96 that extends between the lower surface 82 or 83 and the adjacent edge 39 or end surfaces of the adjacent length or lengths of siding 16 or 16*a*. Thus air can flow into the ventilation space 9 through the lower ventilation channel 110 positioned between the rear surface of the lower portion of the lowermost length of siding 16 and the vertical generally planar surface of the building 13 and out of the ventilation space 9 through the upper ventilation channel 80 to the atmosphere, or can flow into the ventilation space 9** through the upper ventilation channel 80 and out through the lower ventilation channel 110. A narrow rib or lip 109 projecting from the juncture between the perforated wall portion 96 and the lower wall portion 90 provides a drip edge for liquid moisture that may pass through the openings 131 or may otherwise be deposited on the outer surface 98 of the perforated wall portion 96.

The upper ventilation channel 80 can be attached to the underlying structure 11 of the building 13 with its inner wall portion 84 against the vertical outer surface of the underlying structure 11 of the building 13 and its upper wall portion 90 against the lower horizontal surface 82 on the building 13 as illustrated in FIG. 4 by positioning the projecting portions 36 of spacers 10 in the chamber 108, which can be done by inserting the projecting portions 36 of the spacers 10, distal ends first, into the chamber 108 through the opening between the second edge 106 of the lower wall portion 102 and the inner wall portion 84 and then rotating the spacers 10 about 90 degrees to position their rear surfaces 22 against the inner surface 85 of the inner wall portion 84. The spacers 10 can then be nailed to the underlying structure 11 through their front second planes defined by their support surfaces 24 with the upper ventilation channel 80 in the desired location, after which the uppermost length of siding 16 can be attached to the underlying structure 11 through those spacers 10 with its uppermost edge 39 against the outer surface 104 of the lower wall portion 102.

Figure 13:
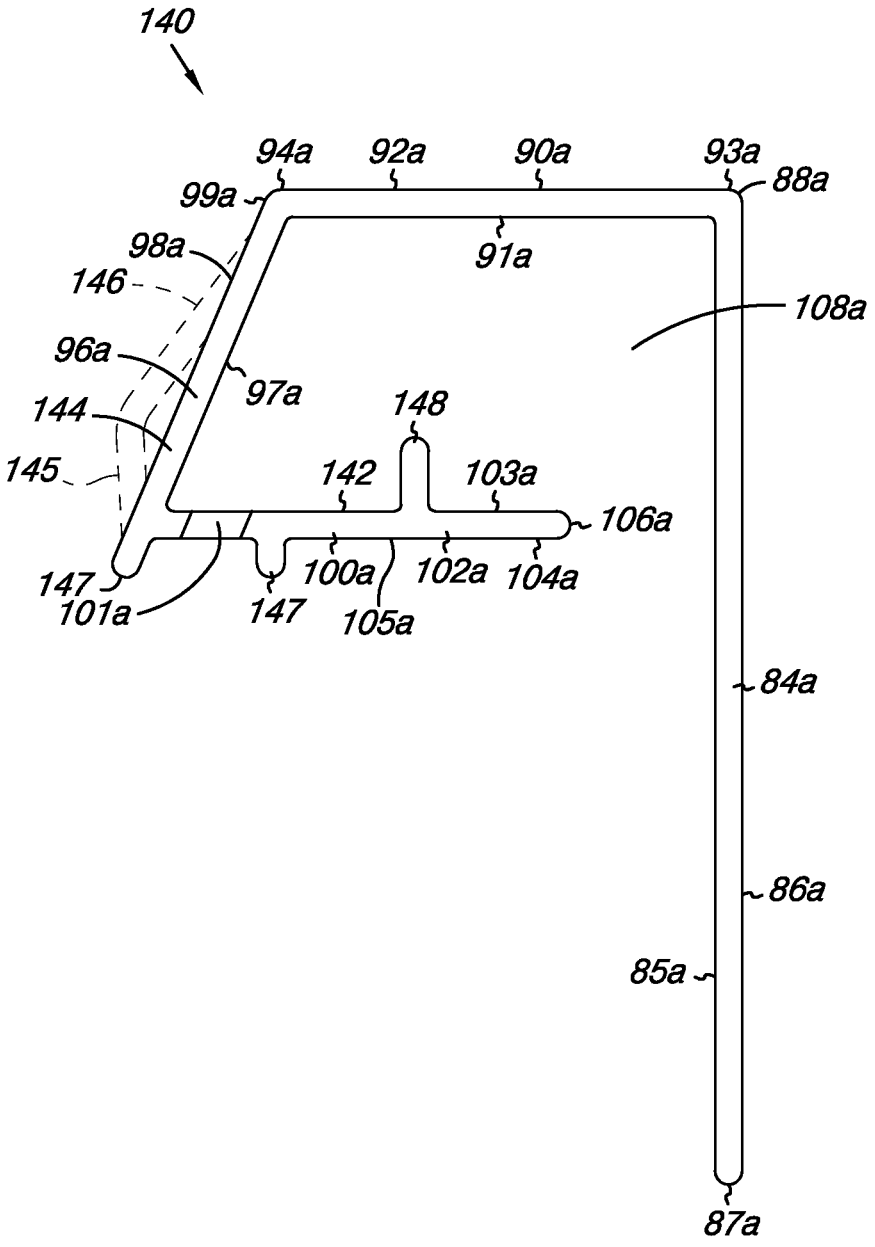
FIG. 13 is an end view of a second embodiment of the upper ventilation channel shown in FIGS. 4 and 6.

FIG. 13 illustrates an alternate embodiment of an upper ventilation channel 140 according to the present invention. The upper ventilation channel 140 has many structural features similar to those of the upper ventilation channel 80 which have been identified with the same reference numerals to which have been added the suffix "a". The upper ventilation channel 140 can be used in the same manner as the upper ventilation channel 80, and can be useful when the lower surface 82 or 83 on the building 13 extends sufficiently past the front surface of the adjacent length of siding 16 or 16*a* to extend entirely over the ventilation channel 140.

Like the upper ventilation channel 80, the upper ventilation channel 140 has wall portions including an elongate planar inner wall portion 84*a* having inner and outer major surfaces 85*a* and 86*a* extending between opposite first and second longitudinally extending edges 87*a* and 88*a*, the outer major surface 86*a* of which inner wall portion 84*a* can be positioned against the vertical generally planar outer surface of the building 13; and an elongate generally planar upper wall portion 90*a* having inner and outer major surfaces 91*a* and 92*a* extending between opposite first and second longitudinally extending edges 93*a* and 94*a*, the first edge 93*a* of the upper wall portion 90*a* being joined to the second edge 88*a* of the inner wall portion 84*a*, and the upper wall portion 90*a* being disposed at about a right angle with respect to the inner wall portion 84*a* with the inner surfaces 85*a* and 91*a* of the wall portions 84*a* and 90*a* adjacent, the outer major surface 92*a* of which upper wall portion 90*a* can be positioned against the lower surface 82 or 83 of the building 13. The wall portions of the upper ventilation channel 140 also include an elongate lower wall portion 102*a* having inner and outer major surfaces 103*a* and 104*a* extending between opposite first and second longitudinally extending edges 105*a* and 106*a*, the lower wall portion 102*a* being disposed generally parallel to the upper wall portion 90*a* with the inner surfaces 91*a* and 103*a* of the upper and lower wall portions 90*a* and 102*a* adjacent and spaced apart and the second edge 106*a* of the lower wall portion 102*a* spaced from the inner wall portion 84*a* by about the minimum dimension of the ventilation space 9 between the outer surface of the underlying structure 11 and the inner surfaces of the lengths of siding 16 spaced apart by the spacers 10, the outer major surface 104*a* of which lower wall portion 102*a* can be positioned against the upper edge 39 of the length of siding 16 or the ends 95 of the lengths of lengths of siding 16*a*. Also, the wall portions of the upper ventilation channel 140 further include an elongate perforated wall portion 96*a* having inner and outer major surfaces 97*a* and 98*a* extending between opposite first and second longitudinally extending edges 99*a* and 100*a*, the first edge 99*a* of the perforated wall portion 96*a* being joined to the second edge 94*a* of the upper wall portion 90*a*, the second edge 100*a* of the perforated wall portion 96*a* being joined to the first edge 105*a* of the lower wall portion 102*a*. The perforated wall portion 96*a* has a row of through openings 101*a* between the inner and outer surfaces 97*a* and 98*a* along the length of the perforated wall portion 96*a*, and includes means of the type described for the upper ventilation channel 80 for restricting movement of insects through the openings 101*a* in the perforated wall portion 96*a*. Also, the outer surface 98*a* of the perforated wall portion 96*a* can be coated or co-extruded with a layer of material (e.g., PVC) that allows it to be painted.

Unlike the perforated wall portion 96 of the upper ventilation channel 80, the perforated wall portion 96*a* of the upper ventilation channel 140 is not planar and disposed at about a right angle with respect to the upper wall portion 90*a*. Rather the perforated wall portion 96*a* of the upper ventilation channel 140 includes a first part 142 adjacent the lower wall portion 102*a* that is adapted to project past the outer surfaces of lengths of siding 16 or 16*a* against the top edge 39 or end surfaces of which the outer surface 104*a* of the lower wall portion 102*a* is positioned. The parts of the inner and outer surfaces 97*a* and 98*a* of the perforated wall portion 96*a* along the first part 142 are generally parallel to and co-planar with the inner and outer surfaces 103*a* and 104*a* of the lower wall portion 102*a*, and the through openings 101*a* between the inner and outer surfaces 97*a* and 98*a* of the perforated wall portion 96*a* are along the length of the first part 142. That location of the through openings 101*a* restricts rain water from entering the openings 101*a* even when rain is driven against the outer surface 98*a* of the perforated wall portion 96*a* as by swirling winds. The perforated wall portion 96*a* of the upper ventilation channel 140, as illustrated, also includes a second generally planner part 144 disposed at an angle of about 25 degrees with respect to the upper wall portion 90*a* that extends from the edge of the first part 142 opposite the lower wall portion 102*a* to the second edge 94*a* of the upper wall portion 90*a*. Alternatively instead of the shape of the second part 144 the perforated wall portion 96*a* can have many different shapers between the edge of the first part 142 opposite the lower wall portion 102*a* and the second edge 94*a* of the upper wall portion 90*a* such as an arcuate shape, or, as indicated in dotted outline, the perforated wall portion 96*a* of the upper ventilation channel 140 could include a second generally planner part 145 disposed at an angle of about 90 degrees with respect to the upper wall portion 90*a* that extends from the edge of the first part 142 opposite the lower wall portion 102*a* toward the upper wall portion 90*a*, together with a third generally planner part 146 disposed at an angle of about 35 degrees with respect to the upper wall portion 90*a* that extends from the edge of the second part opposite the first part 142 to the second edge 94*a* of the upper wall portion 90*a*. Longitudinally extending ribs or lips 147 project away from the outer surface of the first part 142 of the perforated wall portion 96*a* on opposite sides of the through openings 101*a* along the length of the first part 142. Those ribs 147 provide drip edges for liquid moisture that may pass through the openings 101*a* or may otherwise be deposited on the outer surface 98*a* of the perforated wall portion 96*a*. The part of the inner surface 97*a* of the perforated wall portion 96*a* along the first part 142 can be made cylindrically concave or otherwise made to slope toward the openings 101*a* when that part of the inner surface 97*a* is facing upwardly so that any water or moisture that enters the channel through the openings 101*a* or condenses in the channel should exit through the openings 101*a* rather than passing through the space between the second end 106*a* of the lower wall portion 102*a* and the inner wall portion 84*a*. Also, optionally, a longitudinally extending rib or wall 148 can project a short distance toward, while being well spaced from, the upper wall portion 90*a* from the inner surface of the first part 142 of the perforated wall portion 96*a* or from the inner surface 103*a* of the lower wall portion 102*a* between the through openings 101*a* along the length of the first part 142 and the second edge 106*a* of the lower wall portion 102*a*. The rib or wall 148 restricts any moisture that enters the channel through the openings 101*a* from passing through the space between the second end 106*a* of the lower wall portion 102*a* and the inner wall portion 84*a* so that such moisture should again exit through the openings 101*a* rather than entering the ventilation space 9 in the sidewall of the building.

The lower ventilation channel 110 and/or the upper ventilation channels 80 or 140 can also be used to good advantage in an outer wall for a building that has siding of other than lap siding, such as siding of stucco or sheets of wood or another suitable material, where that outer wall includes an underlying structure having a vertical outer surface; the siding is generally coextensive with the vertical outer surface of the underlying structure extending from a lower end to an upper end; and means are provided for supporting the siding on the underlying structure with the rear surface on the siding spaced from the vertical outer surface of the underlying structure to provide a ventilation space between the siding and the underlying structure, which ventilation space has open upper and lower ends respectively at the upper and lower ends of the siding. That means for supporting the siding on the underlying structure with the rear surface on the siding spaced from the vertical outer surface of the underlying structure could, for example, comprise vertical baton strips of the type described above in the "Background" portion of this application extending vertically from the bottom to the top of the underlying structure that are aligned with and attached to studs in the underlying structure to which the siding could be attached; or, to support stucco siding, could include the stiff resiliently flexible corrugated sheet random woven of Nylon polymeric fibers to provide a high percentage of openings through the corrugated sheet (e.g., the corrugated sheet sold under the trademark "Home Slicker"®) described in the Background portion of this application positioned between the underlying structure and the stucco siding, through which sheet the stucco mesh included in the stucco siding is attached to the underlying structure. The lower ventilation channel 110 can then be used between the inner surface of the siding and the outer surface of the underlying structure across the lower opening to the ventilation space at the lower end of the siding; and the upper ventilation channel 80 or 140 can then be used between the uppermost edge of the siding and a lower surface on the building (e.g., a freeze board, soffit, eve or overhang) with its inner wall portion 84 or 84*a* against the vertical outer surface of the underlying structure of the wall, its upper wall portion 90 or 90*a* against the lower surface on the building, and its lower wall portion 102 or 102*a* positioned against the upper edge of the siding, with the space between the second edge 106 or 106*a* of its lower wall portion 102 or 102*a* and its inner wall portion 84 or 84*a* aligned with the open upper end of the ventilation space positioned to afford movement of air through the lower ventilation channel 110, the ventilation space between the rear surface of the siding and the outer surface of the underlying structure of the building, through the space between the second edge 106 or 106*a* of the lower wall portion 102 or 102*a* and the inner wall portion 84 or 84*a* of the upper ventilation channel 80 or 140, transversely through the chamber 108 or 108*a* in the upper ventilation channel 80 or 140, and through the openings 101 or 101*a* in the perforated wall portion 96 or 96*a* of the upper ventilation channel 80 or 140.

Figure 14:
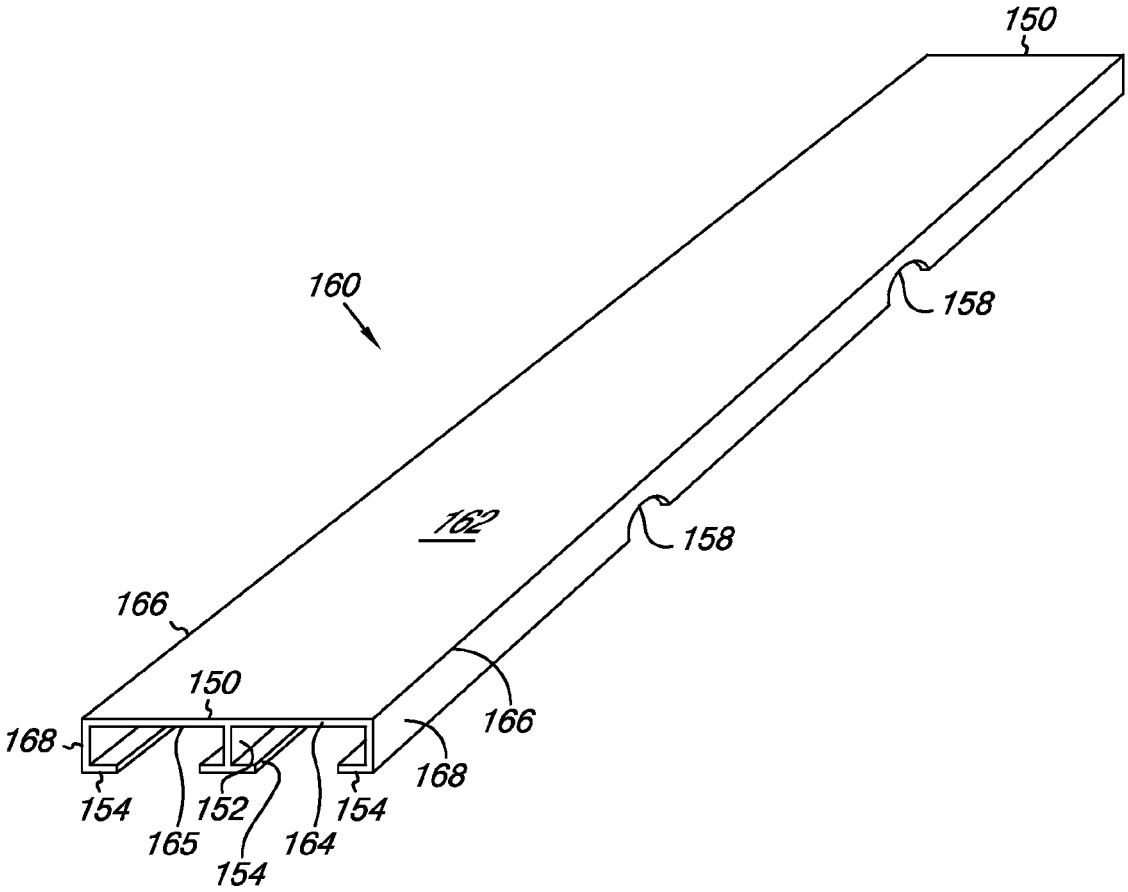
FIG. 14 is a perspective view of a spacing strip according to the present invention.

That means for supporting the siding on the underlying structure with the rear surface on the siding spaced from the vertical outer surface of the underlying structure could also preferably comprise spacing strips 160 of the type illustrated in FIG. 14 extending or spaced vertically along and spaced horizontally along the outer surface of the underlying structure to which the siding is attached in alignment with and attached to studs in the underlying structure, with the sheet material siding or the stucco mesh included in the stucco siding supported on outer surfaces 162 of the spacing strips 160 and attached to the underlying structure through the spacing strips 160

The spacing strip 160 is an extrusion of polymeric material (e.g., ABS) having wall portions of generally uniform thickness (e.g., wall portions 0.045 inch or 0.114 cm thick) comprising a transverse wall portion 164 having opposite generally parallel edges 166 and outer and inner major surfaces 162 and 165. The outer surface 162 of the transverse wall portion 164 is generally planar and provides the outer surface 162 of the spacing strip 160 adapted to have the inner surface of the siding positioned along it. The wall portions of the spacing strip 160 further include projections from the inner surface 165 of the transverse wall portion 164 including two outer projections 168 extending between opposite ends 150 of the spacing strip 160 with one of the outer projections 168 extending along each of the parallel edges 166 of the transverse wall portion 164, and a central projection 152 extending between and generally parallel to the outer projections 168 between the ends 150 of the spacing strip 160. The projections 168 and 152 have distal end portions having rear surfaces 154 opposite the transverse wall portion 164, which distal end portions and rear surfaces 154 are wider than parts of the projections 168 and 152 adjacent the transverse wall portion 164, with the rear surfaces 154 generally in a plane parallel to the outer surface 162 of the transverse wall portion 164. The rear surfaces 154 are adapted to be supported against the outer surface of the underlying structure. The outer projections 168 are generally L shaped in cross section with the distal ends of the end portions adjacent and pointed toward each other. The central projection 152 is generally T shaped in cross section with the base of the T attached to the transverse wall portion 164. The width of the spacing strip 160 between the edges 166 can be about 1.5 inches or 3.8 cm to generally correspond to the width of studs in the underlying structure to which the siding will be attached through the spacing strip 160. The spacing strip 160 can have a thickness between its front and rear surfaces 162 and 154 selected to provide the desired with of the ventilation space (e.g., in the range of ⅛ to 1 inch or 0.3 to 2.43 cm, more typically in the range of ¼ to ⅜ inch or 0.6 to 1 cm). The length of the spacing strip 160 between its ends 150 can be very short (e.g., 1 to 3 inches or 2.54 to 7.6 cm) which would require the use and positioning of many spaced apart spacing strips 160 between the underlying structure and the siding. Alternatively, the spacing strip 160 can be much longer (e.g., up to 4 to 8 feet or 122 to 244 cm long or more) which could require less labor to position spacing strips 160 on the underlying structure. Spacing strips 160 having lengths of about 1 foot or greater should have transverse channels 158 formed through the projections 168 and 152 between the edges 166 at spaced locations (e.g., every 6 inches or 15 cm) as illustrated in FIG. 14 to provide a path through which air can circulate horizontally in the ventilation space. The spacing strip 160 could also have spaced grooves (not illustrated) extending between its ends 150 or between its edges 166 to facilitate movement of air between the siding and spaced front surfaces formed by the grooves.

Figure 7:
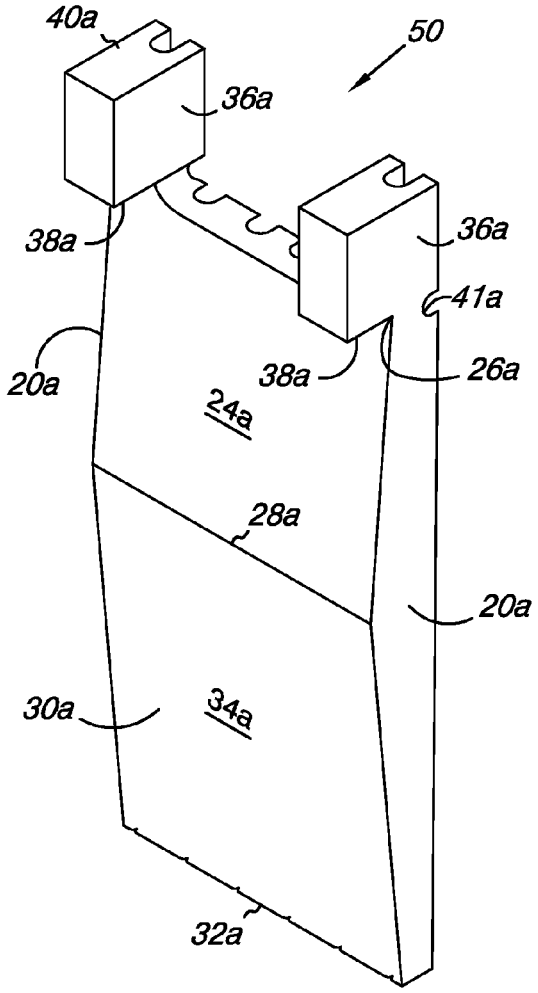
FIG. 7 is a top, front, right side perspective view of a second embodiment of a spacer according to the present invention.
Figure 8:
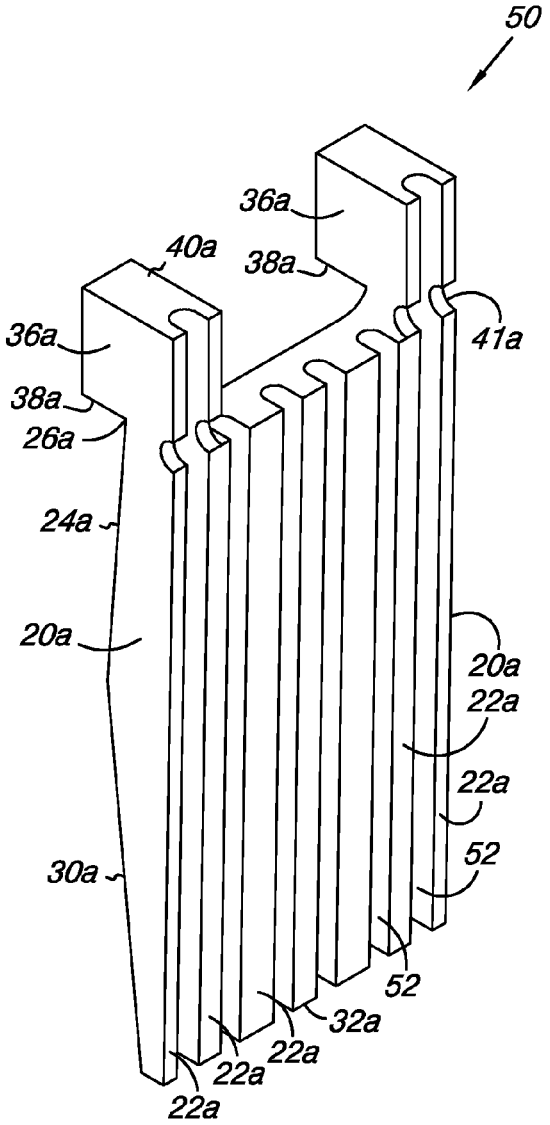
FIG. 8 is a top, rear, right side view of the spacer of FIG. 7.

FIGS. 7 and 8 illustrate a second alternate embodiment of a spacer according to the present invention generally designated by the reference numeral 50. The spacer 50 can be used in the same manner as the spacer 10, but is better adapted to be molded in that the spacer 50 has less thick portions. The spacer 50 has many structural features similar to those of the spacer 10 which have been identified with the same reference numerals to which have been added the suffix "a". Like the spacer 10, the spacer 50 has a width between parallel side surfaces 20*a* that is about the same as the width of the side surface of the framing 15 (e.g., 2×4 wood framing) in the underlying structure 11 with which they will be aligned. The spacer 50 has spaced elongate co-planar rear surfaces 22*a* generally in and defining a first plane. The rear surfaces 22*a* are adapted to be positioned against the generally planar outer surface of the underlying structure 11. The spacer 50 also has a support surface 24*a* generally in and defining a second plane on the side of the spacer 50 opposite the rear surfaces 22*a*. The second plane is disposed at a small acute angle (e.g., in the range of about 1.5 to 4 degrees and preferably in the range of about 2 to 3 degrees) with respect to the first plane defined by the rear surfaces 22*a*, at which small acute angle it is desired to have the rear surfaces of the lengths of siding 16 disposed with respect to the outer surface of the underlying structure 11. The second plane defined by the support surface 24*a* diverges away from the rear surfaces 22*a* at that small acute angle from a first or upper edge 26*a* of the second plane defined by the support surface 24*a* toward a second or lower edge 28*a* of the second plane and of the support surface 24*a*. The spacer 50 has a predetermined thickness between its first and second planes (e.g., about ¼ inch or 0.64 cm) at and along the first edge 26*a* of the second plane, which predetermined thickness defines the minimum dimension of the ventilation space 9 the spacer 50 will provide between the outer surface of the underlying structure 11 and the inner surfaces of the lengths of siding 16. The spacer 50 includes a tapered portion 30*a* extending from the second edge 28*a* of second plane defined by the front surface portion 24*a* to a bottom end 32*a* of the spacer 50. That tapered portion 30*a* has a generally planar wedge surface 34*a* generally in and defining a third plane that converges away from the second edge 28*a* toward the first plane defined by the rear surface 22*a* at an acute angle (e.g., about 20 degrees) between the third plane defined by the front wedge surface 34*a* and the first plane defined by the rear surfaces 22*a*. The front wedge surface 34*a* and the rear surfaces 22*a* form a wedge that can facilitate inserting the spacer between the siding 16 and the underlying structure 11. The spacer 50 also includes two spaced projecting portions 36*a* having spaced co-planar stop surfaces 38*a* at the first edge 26*a* of and projecting above the second plane defined by the support surface 24*a*. The stop surfaces 38*a* are disposed at about a right angle with respect to the support surface 24*a* but could be disposed at other angles. The stop surfaces 38*a* facilitate alignment of the first edge 26*a* of the second plane with a top edge surface 39 of one of the lengths of siding 16. The projecting portions 36*a* facilitate manual engagement with a spacer 50 for the purposes described above with respect to the spacer 10. The projecting portions 36*a* extend from the stop surfaces 38*a* to a top end 40*a* of the spacer 10 and project above the first edge 26*a* of the second plane a distance no greater than the thickness along the top edge surfaces of the lengths of siding with which the spacer 50 is intended to be used.

The spacer 50 has a groove 41*a* recessed from its rear surface 22*a* and aligned with the first edge 26*a* of the second plane defined by the support surface 24*a*. The groove 41*a* affords breaking the spacer 50 along the groove 41*a* to separate the projecting portions 36*a* from a portion of the spacer 50 between the first edge 26*a* and the bottom end 32*a* of the spacer 50 for the purpose described above with respect to the spacer 10. The spacer 50 has a plurality of parallel spaced recesses 52 from its planar rear surface 22*a* and extending from the bottom end 32*a* to the top end 40*a* of the spacer 50 to afford movement of air between the spacer 50 and the planar outer surface of the underlying structure 11 against which the rear surfaces 22*a* of the spacer 50 are positioned.

Figure 9:
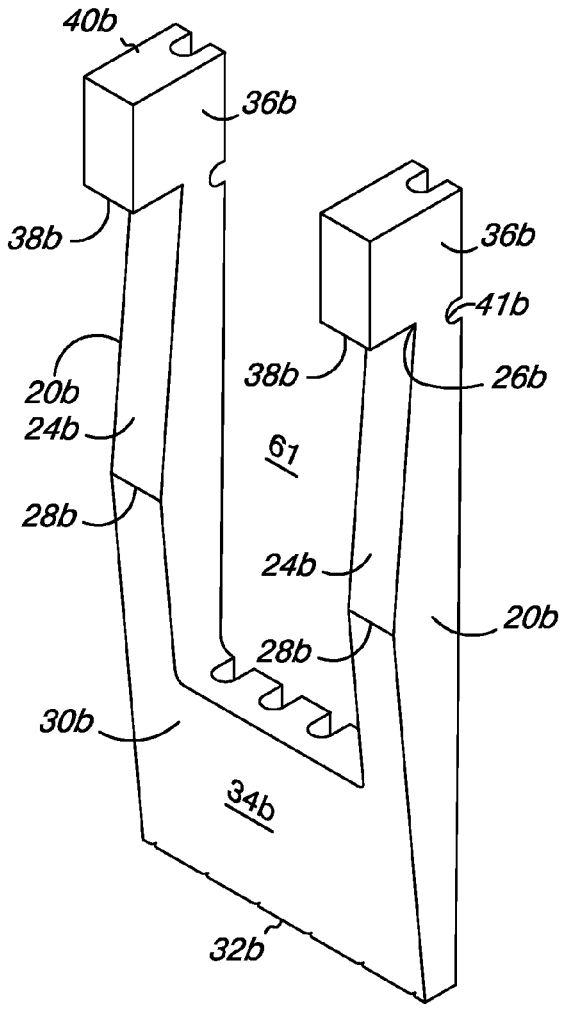
FIG. 9 is a top, front, right side perspective view of a third embodiment of a spacer according to the present invention.
Figure 10:
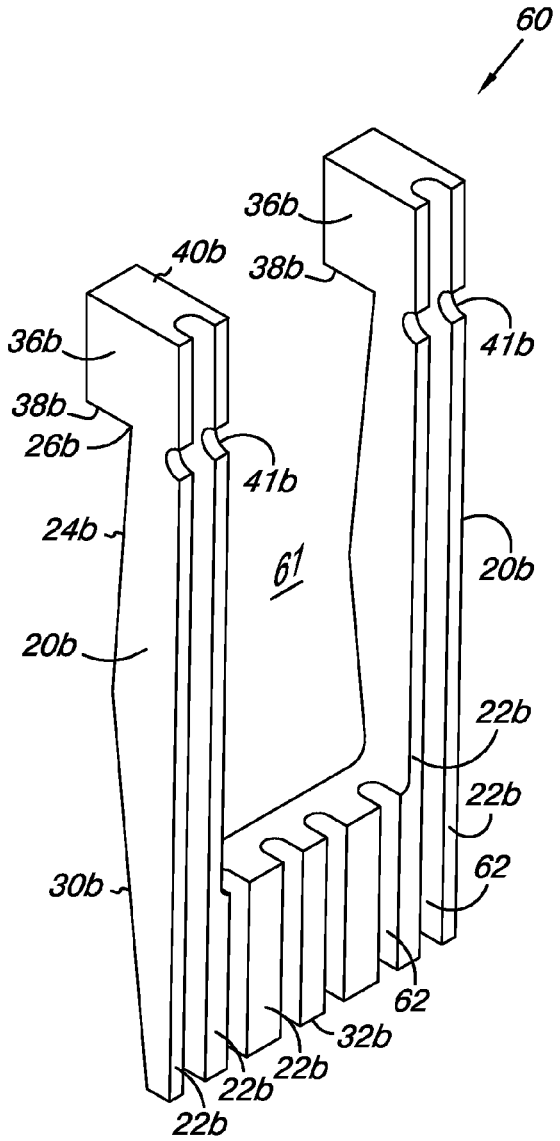
FIG. 10 is a top, rear, right side view of the spacer of FIG. 9.

FIGS. 9 and 10 illustrate a third embodiment of a spacer according to the present invention that is generally designated by the reference numeral 60. The spacer 60 can be used in the same manner as the spacers 10 and 50, and like the spacer 50 is better adapted to being molded than the spacer 10 in that the spacer 60 has less thick portions. The spacer 60 has many structural features similar to those of the spacer 10 which have been identified with the same reference numerals to which have been added the suffix "b".

The spacer 60 differs from the spacer 50 in that a generally U-shaped central portion of the spacer 60 is not present so that the spacer 50 has a passageway 61 that extends through the spacer 60 between the center of the second plane defined by front support surfaces 24*b* and a first plane defined by rear surfaces 22*b*. Thus, the spacer 60 will provide little or no resistance to a fastener inserted through a length of siding 16, generally centrally through the second plane defined by the support surfaces 24*b* of the spacer 60, and into the underlying structure 11, which fastener will pass through that U-shaped passageway 61. Compared to the continuous support surfaces 24 and 24*a* of the spacers 10 and 50, however, the support surfaces 24*b* of the spacer 60 will not provide as much support for the rear surface of the length of siding 16 around the fastener as it passes through the length of siding 16 which could allow portions of the siding 16 around that fastener to be broken out as the fastener passes through the length of siding 16.

Like the spacer 10, the spacer 60 has a width between parallel side surfaces 20*b* that is about the same as the width of the side surface of the framing 15 (e.g., 2×4 wood framing) in the underlying structure 11 with which they will be aligned. The spacer 60 has parallel spaced elongate rear surfaces 22*b* generally in and defining the first plane, which rear surfaces 22*b* are adapted to be positioned against the generally planar outer surface of the underlying structure 11. The spacer 60 also has the spaced elongate support surfaces 24*b* on the side of the spacer 60 opposite the rear surfaces 22*b*, which support surfaces 24*h* are generally in and define the second plane disposed at a small acute angle (e.g., about 1.5 to 4 degrees and preferably about 2 to 3 degrees) with respect to the first plane defined by the rear surfaces 22*b*, at which small acute angle it is desired to have the rear surfaces of the lengths of siding 16 disposed with respect to the outer surface of the underlying structure 11. The second plane defined by the support surfaces 24*b* diverges away from the first plane defined by the rear surfaces 22*b* at that small acute angle from a first or upper edge 26*b* of the second plane defined by the support surfaces 24*b* toward a second or lower edge 28*b* of that plane. The spacer 60 has a predetermined thickness between the second plane defined by its support surfaces 24*b* and the first plane defined by its rear surfaces 22*b* (e.g., about ¼ inch) at and along the first edge 26*b*, which predetermined thickness defines the minimum dimension of the ventilation space 9 that the spacer 60 will provide between the outer surface of the underlying structure 11 and the inner surfaces of the lengths of siding 16. The spacer 60 includes a tapered portion 30*b* extending from the second edge 28*b* of the second plane defined by the support surfaces 24*b* to a bottom end 32*b* of the spacer 60. The tapered portion 30*b* has a front wedge surface 34*b* generally in and defining a third plane that converges away from the second edge 28*b* of the second plane defined by the support surfaces 24*b* toward the first plane defined by the rear surfaces 22*b* at an acute angle (e.g., about 20 degrees) between the third and first planes defined by the wedge and rear surfaces 34*b* and 22*b*. The wedge and rear surfaces 34*b* and 22*b* form a wedge that can facilitate inserting the spacer 60 between the siding 16 and the underlying structure 11. The spacer 60 also includes two spaced projecting portions 36*b* having spaced co-planar stop surfaces 38*b* at the first edge 26*b* defined by the second plane and projecting above the support surfaces 24*b*, which stop surfaces 38*b* are disposed at about a right angle with respect to the second plane defined by the support surfaces 24*b*. The stop surfaces 38*b* facilitate alignment of the first edge 26*b* of the second plane with a top edge surface 39*b* of one of the lengths of siding 16. The projecting portions 36*b* facilitate manual engagement with the spacer 60 for the purposes described above with respect to the spacer 10. The projecting portions 36*b* extend from the stop surface 38*b* to a top end 40*b* of the spacer 60 and should project above the first edge 26*b* of the second plane defined by the support surfaces 24*b* a distance no greater than the thickness along the top edge surfaces of the lengths of siding 16 with which the spacer 60 is intended to be used.

The spacer 60 has grooves 41*b* recessed from its rear surface 22*b* and aligned with the first edge 26*h* of the second plane defined by the support surfaces 24*b*. The grooves 41*b* afford breaking the spacer 50 along the grooves 41*a* for the purpose described above with respect to the spacer 10. The spacer 60 has a plurality of parallel spaced recesses 62 between the rear surfaces 22*b* and extending from the bottom end 32*b* of the spacer 60 to the top end 40*b* of the spacer 60 to afford movement of air between the spacer 60 and the generally planar outer surface of the underlying structure 11 against which the rear surfaces 22 of the spacer 60 are positioned.

Figure 11:
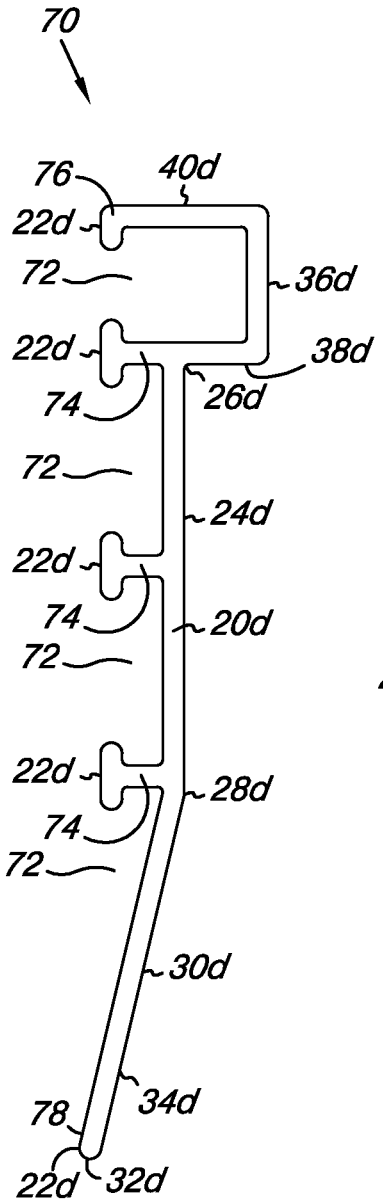
FIG. 11 is a left side view of a fourth embodiment of a spacer according to the present invention.
Figure 12:
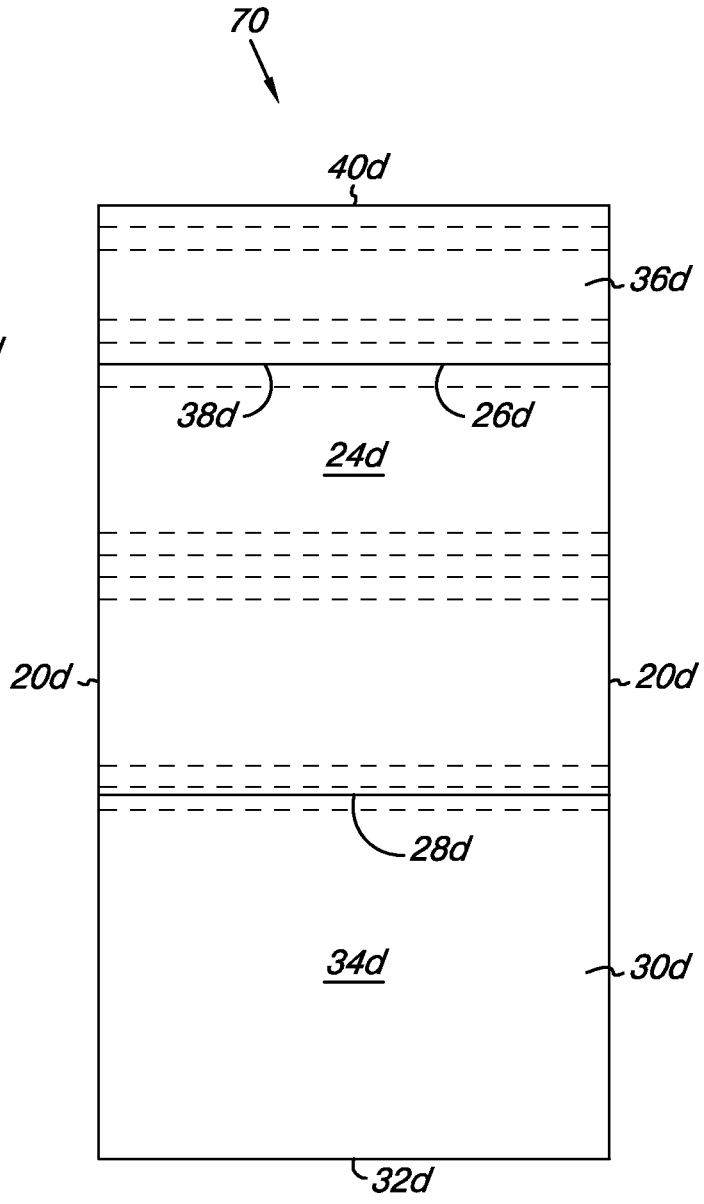
FIG. 12 is a front view of the spacer of FIG. 11.

FIGS. 11 and 12 illustrate a fourth alternate embodiment of a spacer according to the present invention generally designated by the reference numeral 70 that can be used in the same manner as the spacer 10. The spacer 70 is an extrusion of polymeric material (e.g., ABS) having walls portions of generally uniform thickness (e.g., wall portions 0.045 inch or 0.114 cm thick). The spacer 70 has many structural features similar to those of the spacer 10 which have been identified with the same reference numerals to which have been added the suffix "d". The spacer 70 has parallel side surfaces 20*a* formed by transversely cutting the extrusion from which the spacer 70 is made. Like the spacer 10, the spacer 70 has a width between its side surfaces 20*a* that is about the same as the width of the side surface of the framing 15 (e.g., 2×4 wood framing) in the underlying structure 11 with which they will be aligned. The spacer 70 has transverse spaced elongate generally co-planar rear surfaces 22*d* generally in and defining a first plane. The rear surfaces 22*d* are adapted to be positioned against the generally planar outer surface of the underlying structure 11. The spacer 70 also has a continuous front support surface 24*d* in and defining a second plane on the side of the spacer 70 opposite its rear surfaces 22*d*. The second plane defined by the support surface 24*d* is disposed at a small acute angle (e.g., in the range of about 1.5 to 4 degrees and preferably in the range of about 2 to 3 degrees) with respect to the first plane defined by the rear surfaces 22*d*, at which small acute angle it is desired to have the rear surfaces of the lengths of siding 16 disposed with respect to the outer surface of the underlying structure 11. The second plane defined by the support surface 24*d* diverges away from the first plane defined by the rear surfaces 22*d* at that small acute angle from a first or upper edge 26*d* of the second plane toward a second or lower edge 28*d* of the second plane and the support surface 24*d*. The spacer 70 has a predetermined thickness at and along the first edge 26*d* between the second plane defined by its support surface 24*a* and the first plane defined by its rear surfaces 22*d* (e.g., about ¼ inch or 0.64 cm), which predetermined thickness defines the minimum dimension of the ventilation space 9 the spacer 70 will provide between the outer surface of the underlying structure 11 and the inner surfaces of the lengths of siding 16. The spacer 70 includes a tapered portion 30*d* extending from the second edge 28*d* of the second plane to a bottom end 32*d* of the spacer 70. That tapered portion 30*d* has a generally planar wedge surface 34*d* in and defining a third plane that converges away from the second edge 28*d* toward the first plane defined by the rear surfaces 22*d* at an acute angle (e.g., about 12 degrees) between the third plane defined by the wedge surface 34*d* and the first plane defined by the rear surfaces 22*d*. The wedge and rear surfaces 34*d* and 22*d* form a wedge that can facilitate inserting the spacer 70 between the siding 16 and the underlying structure 11. The spacer 70 also includes a projecting portion 36*d* having a stop surface 38*d* at the first edge 26*d* of the second plane defined by the support surface 24*d* and projecting above that second plane. The stop surface 38*d* is disposed at about a right angle with respect to the second plane. The stop surface 38*d* facilitates alignment of the first edge 26*d* of the second plane with a top edge surface 39 of one of the lengths of siding 16. The projecting portion 36*d* facilitates manual engagement with the spacer 70 for the purposes described above with respect to the spacer 10. The projecting portion 36*d* extends from the stop surface 38*d* to a top end 40*d* of the spacer 70 and should project above the first edge 26*d* of the second plane a distance no greater than the thickness along the top edge surfaces of the lengths of siding with which the spacer 70 is intended to be used.

The spacer 70 has a plurality of (i.e., 4) parallel spaced recesses 72 from the first plane defined by its planar rear surfaces 22*a*, which recesses 72 extending transversely between the side surfaces 20*a* of the spacer 70 to afford movement of air between the spacer 70 and the planar outer surface of the underlying structure 11 against which the rear surfaces 22*a* of the spacer 70 are positioned. Those recesses 72 are defined by three projections 74 having generally T shaped cross sections, which projections 74 project from the rear surfaces of walls having the support and wedge surfaces 24*d* and 34*d* and the stop surface 38*d* on their sides opposite the projections 74. The T shaped projections 74 have three of the rear surfaces 22*d* on their distal ends, the other rear surfaces 22*d* being on an L shaped end portion 76 on a wall forming the top end 40*d* of the spacer 70, and on a distal end 78 of the wall having the wedge surface 34*d*.

Several aspects of the present invention have now been described, including, but not limited to, four embodiments of a spacer and several possible modifications thereof, methods for using the spacer, an outer sidewall of a building made using a plurality of the spacers, lower and upper ventilation channels, and an outer wall of a building with a ventilation space between its siding and its underlying structure including the lower and upper ventilation channels. It will be apparent to those skilled in the art that many changes can be made in the embodiments, structures and methods described without departing from the scope of the present invention. For example, the support surfaces or support surfaces of the spacer could be oval or circular so that its side surfaces have arcuate or semi-circular portions, and/or the side surfaces along the tapered portion could converge toward the bottom edge of the spacer. Also, even if the second plane defined by the support surface or support surfaces was disposed at a first angle of 0 degrees with respect to the first plane defined by its rear surface or rear surfaces (i.e., the support surface or support surfaces were parallel to its rear surface or rear surfaces), use of the spacer 10 would be a significant improvement over the use of vertical baton strips as described above between a planar outer surface of an underlying structure of the side of a building and portions of lengths of overlapped siding through which spacer the lengths of siding are nailed to the underlying structure to provide a ventilation space because that ventilation space would allow better horizontal cross ventilation between the lengths of siding and the underlying structure. Thus, the useful range of the angle between the second plane defined by the support surface or support surfaces and the plane defined by the rear surface or rear surfaces is about 0 to 4 degrees. The spacers described can be used to attach lengths of siding of materials other than fiber cement, which could include, but are not limited to, materials such as wood, masonite, or vinyl. Thus, the scope of the present invention should not be limited to the structures and methods described in this application, but only by the structures and methods described by the language of the claims and the equivalents thereof.

What is claimed is:

1. A ventilation channel adapted to be positioned between a lower surface on a building and an uppermost edge or end edges of siding attached to a vertical planar outer surface of an underlying structure of an outer wall of the building and spaced from the outer surface of the underlying structure by means that provide a ventilation space between the rear surface of the siding and the outer surface of the underlying structure, said ventilation channel having wall portions including an elongate generally planar inner wall portion having inner and outer major surfaces extending between opposite first and second longitudinally extending edges and adapted to have said outer major surface positioned against the vertical surface of the underlying structure of the building, an elongate generally planar upper wall portion having inner and outer major surfaces extending between opposite first and second longitudinally extending edges, the first edge of the upper wall portion being joined to the second edge of the inner wall portion, said upper wall portion being disposed at about a right angle with respect to said inner wall portion with said inner surfaces of said inner and upper wall portions adjacent to each other and the outer surface of said upper wall portion being adapted to be positioned against the lower surface on the building, an elongate lower wall portion having inner and outer major surfaces extending between opposite first and second longitudinally extending edges, said lower wall portion being disposed about parallel to said upper wall portion with said inner surfaces of said upper and lower wall portions adjacent to each other, the second edge of the lower wall portion being spaced from the inner wall portion, and the outer surface of said lower wall portion being adapted to be positioned against the upper edge or end edges of the siding, and an elongate perforated wall portion having inner and outer major surfaces extending between opposite first and second longitudinally extending edges, the first edge of the perforated wall portion being joined to the second edge of the upper wall portion, the second edge of the perforated wall portion being joined to the first edge of the lower wall portion, said perforated wall portion being disposed with said inner surfaces of said upper, perforated, and lower wall portions adjacent to each other, and said perforated wall portion having transverse spaced surfaces between the inner and outer surfaces of said perforated wall portion defining perforations along the length of the perforated wall portion, the space between said second edge of said lower wall portion and said inner wall portion affording movement of air from said ventilation space between the rear surface of the siding and the underlying structure of the building, transversely through said ventilation channel, and through the perforations in said perforated wall portion.

2. The ventilation channel according to claim 1 wherein said perforated wall portion is generally planar and is disposed at about a right angle with respect to said upper wall portion.

3. The ventilation channel according to claim 1 wherein said perforated wall portion includes a first part having said second edge and having said spaced transverse surfaces defining the perforations, said first part being generally planar, being generally parallel to said lower wall portion, and being adapted to project from a front surface of the siding, said perforated wall portion further including a second part or parts extending between an edge of said first part opposite said lower wall portion and the second edge of said upper wall portion.

4. The ventilation channel according to claim 1 further including means for restricting movement of insects through the perforations in said perforated wall portion.

5. The ventilation channel according to claim 1 in which said transverse surfaces defining the widths of the perforations are spaced to restrict movement of insects through the perforations in said perforated wall portion.

6. The ventilation channel according to claim 1 in which a part of said inner wall portion adjacent the first edge of the inner wall portion projects past the outer surface of said lower wall portion.

7. In combination, an outer wall for a building, said wall comprising:

an underlying structure having a vertical outer surface, siding having opposite front and rear surfaces generally coextensive with said vertical outer surface extending from a lower end to an upper end; and means for supporting said siding on said underlying structure with said rear surface spaced from said vertical outer surface to provide a ventilation space between the rear surface of the siding and the outer surface of the underlying structure, said ventilation space having an opening at said lower end of said siding and at said upper end of said siding; and a ventilation channel between the upper end of the siding and a lower surface on the building, said upper ventilation channel having wall portions including:

an elongate planar inner wall portion having inner and outer major surfaces extending between opposite first and second longitudinally extending edges and having said outer major surface positioned against the vertical outer surface of the underlying structure of the wall, an elongate planar upper wall portion having inner and outer major surfaces extending between opposite first and second longitudinally extending edges, the first edge of the upper wall portion being joined to the second edge of the inner wall portion, said upper wall portion being disposed at about a right angle with respect to said inner wall portion with said inner surfaces of said inner and upper wall portions adjacent to each other and the outer surface of said upper wall portion positioned against the lower surface on the wall, an elongate lower wall portion having inner and outer major surfaces extending between opposite first and second longitudinally extending edges, said lower wall portion being disposed about parallel to said upper wall portion with said inner surfaces of said perforated and lower wall portions adjacent to each other, the second edge of the lower wall portion being spaced from the inner wall portion by a dimension about equal to the width of the ventilation space between the outer surface of the underlying structure and the inner surface of the siding, and the outer surface of said lower wall portion being positioned against the upper end of the siding, and an elongate perforated wall portion having inner and outer major surfaces extending between opposite first and second longitudinally extending edges, the first edge of the perforated wall portion being joined to the second edge of the upper wall portion, the second edge of the perforated wall portion being joined to the first edge of the lower wall portion, said perforated wall portion being disposed with said inner surfaces of said upper, lower, and perforated wall portions adjacent to each other, and said perforated wall portion having transverse spaced surfaces between the inner and outer surfaces of said perforated wall portion defining perforations along the length of the perforated wall portion, the space between said second edge of said lower wall portion and said inner wall portion affording movement of air through said ventilation space between the rear surface of the siding and the underlying structure of the building, transversely through said ventilation channel, and through the perforations in said perforated wall portion.

8. The combination according to claim 7 wherein said perforated wall portion is generally planar and is disposed at about a right angle with respect to said upper wall portion.

9. The combination according to claim 7 wherein said perforated wall portion includes a first part having said second edge and having said spaced transverse surfaces defining the perforations, said first part being generally planar being generally parallel to said lower wall portion, and projecting from said front surface of the siding, said perforated wall portion further including a second part or parts extending between an edge of said first part opposite said lower wall portion and the second edge of said upper wall portion.

10. The combination according to claim 7 further including means for restricting movement of insects through the perforations in said perforated wall portion.

11. The combination according to claim 7 in which said transverse surfaces defining the widths of the perforations are spaced to restrict movement of insects through the perforations in said perforated wall portion.

* * * * *